US012274326B2

(12) United States Patent
Tateno

(10) Patent No.: US 12,274,326 B2
(45) Date of Patent: Apr. 15, 2025

(54) SHOE

(71) Applicant: ASICS CORPORATION, Hyogo (JP)

(72) Inventor: Kenta Tateno, Kobe (JP)

(73) Assignee: ASICS CORPORATION, Hyogo (JP)

( * ) Notice: Subject to any disclaimer, the term of this patent is extended or adjusted under 35 U.S.C. 154(b) by 0 days.

(21) Appl. No.: 18/265,622

(22) PCT Filed: Dec. 7, 2020

(86) PCT No.: PCT/JP2020/045434
§ 371 (c)(1),
(2) Date: Jun. 6, 2023

(87) PCT Pub. No.: WO2022/123620
PCT Pub. Date: Jun. 16, 2022

(65) Prior Publication Data

US 2024/0023676 A1 Jan. 25, 2024

(51) Int. Cl.
*A43B 23/26* (2006.01)
*A43B 7/14* (2022.01)
*A43B 23/02* (2006.01)

(52) U.S. Cl.
CPC ..... *A43B 23/26* (2013.01); *A43B 7/14* (2013.01); *A43B 23/0235* (2013.01)

(58) Field of Classification Search
CPC ..... A43B 23/26; A43B 23/0235; A43B 7/14; A43B 7/1495
USPC ..... 36/54
See application file for complete search history.

(56) References Cited

U.S. PATENT DOCUMENTS 436,544 A * 9/1890 Rapp ..... A43B 23/047 36/51
2,530,637 A * 11/1950 Taylor ..... A43B 7/1495 36/170
4,053,995 A * 10/1977 Shein ..... A43B 7/14 36/88
5,416,987 A * 5/1995 Bemis ..... A43B 11/00 36/50.1

(Continued)

FOREIGN PATENT DOCUMENTS

WO 2020/202322 A1 10/2020

OTHER PUBLICATIONS

International Search Report issued in International Application No. PCT/JP2020/045434 dated Jan. 12, 2021 with English translation.

*Primary Examiner* — Marie D Bays
(74) *Attorney, Agent, or Firm* — Rimon P.C.

(57) ABSTRACT

A shoe includes an upper body, a shoe tongue, and a shoelace. The shoe tongue includes a cover portion that covers a central opening of the upper body and a first extending portion-extending from the cover portion along an inner surface of a first wall portion of the upper body. The first extending portion is made of a material higher in stretchability than a material forming the first wall portion. A top end portion of the first wall portion is provided with an upper body-side first shoelace passing-through portion through which the shoelace is inserted from a side of the second wall portion and folded back, and the shoe tongue is provided with a shoe tongue-side first shoelace passing-through portion through which the shoelace is inserted from a side of the second wall portion and folded back.

20 Claims, 25 Drawing Sheets

(56) References Cited

U.S. PATENT DOCUMENTS

| | | | | |
|---|---|---|---|---|
| 5,940,990 | A * | 8/1999 | Barret | A43B 5/0405 36/55 |
| 5,966,841 | A * | 10/1999 | Barret | A43B 23/26 36/50.1 |
| 6,925,734 | B1 * | 8/2005 | Schaeffer | A43B 7/1495 36/169 |
| 8,869,432 | B1 * | 10/2014 | Koo | A43B 3/08 36/51 |
| 2006/0053658 | A1 * | 3/2006 | Voughlohn | A43C 1/06 36/50.1 |
| 2010/0205832 | A1 * | 8/2010 | Takada | A43C 1/00 36/50.1 |
| 2012/0124866 | A1 * | 5/2012 | Moriyasu | A43C 1/003 36/83 |
| 2013/0192091 | A1 * | 8/2013 | Kohatsu | A43B 7/1495 36/103 |
| 2014/0101975 | A1 * | 4/2014 | Ueda | A43B 13/141 36/131 |
| 2015/0121724 | A1 * | 5/2015 | Sung | A43B 7/24 36/83 |
| 2017/0079372 | A1 * | 3/2017 | Duarte | A43B 7/226 |
| 2021/0244132 | A1 | 8/2021 | Ishikawa et al. | |

* cited by examiner

SHOE

CROSS-REFERENCE OF RELATED APPLICATIONS

This application is the U.S. National Phase under 35 U.S.C. § 371 of International Patent Application No. PCT/JP2020/045434, filed on Dec. 7, 2020, the entire disclosure of which Application is incorporated by reference herein.

TECHNICAL FIELD

The present invention relates to a shoe and particularly to a shoe equipped with a shoelace.

BACKGROUND ART

Conventionally, there has been known a shoe having an upper equipped with a shoelace. In order to bring the shoe into closer contact with a foot of a wearer, the shoelace is inserted through a shoelace passing-through portion in an upper body and then tightened.

Normally, in the shoe equipped with a shoelace, a portion of the upper body that corresponds to an instep of the wearer's foot has a central opening provided to extend in the front-rear direction of the shoe, and a plurality of shoelace passing-through portions are provided along the peripheral edge of the central opening. The shoelace is inserted through these shoelace passing-through portions in prescribed order to extend over the central opening and then tightened to thereby tighten a portion of the upper body that defines the central opening, so that the shoe is brought into close contact with the wearers foot.

In general, shoes are preferably balanced between: a fit achieved during a low-intensity exercise (what is called a stationary fit), for example, in the state in which a wearer is not moving or is walking at low speed; and a fit achieved during a high-intensity exercise (what is called a dynamic fit), for example, in the state in which a wearer is walking or running at high speed. A stationary fit is achieved when the shoe moderately fits the wearer's foot while the feeling of restraint by the shoe is reduced. A dynamic fit is achieved when the foot is kept being moderately held by the shoe that follows the movement of the wearer's foot.

However, it is significantly difficult to achieve the balance between the stationary fit and the dynamic fit. In other words, when the upper body is formed of a highly stretchable member in order to enhance the stationary fit, the rigidity of the upper body becomes insufficient, and thereby, the foot cannot be sufficiently held by the shoe during a high-intensity exercise, which results in a poor dynamic fit. On the other hand, when the upper body is formed of a highly rigid member in order to enhance the dynamic fit, the stretchability of the upper body becomes insufficient, and thus, the shoe significantly compresses the foot during a low-intensity exercise to thereby strengthen the feeling of restraint, which results in a poor stationary fit.

International Publication No. 2020/202322 (PTL 1) discloses a shoe including an upper provided with a pair of support members each having a shoelace passing-through portion, in which the shoe is equipped with a shoelace that is inserted through a shoelace passing-through portion in an upper body and shoelace passing-through portions in the pair of support members. In the shoe disclosed in PTL 1, one end of one support member is fixed inside the shoe, specifically at a lower position on the medial foot side of the shoe while the other end of this one support member is provided with a shoelace passing-through portion and exposed to the outside of the upper body through a hole provided at a position on the lateral foot side of the upper body. Also, one end of the other support member is fixed inside the shoe, specifically at a lower position on the lateral foot side of the shoe while the other end of this other support member is provided with a shoelace passing-through portion and exposed to the outside of the upper body through a hole provided at a position on the medial foot side of the upper body.

In the shoe configured as described above, when the foot moves inside the shoe during a high-intensity exercise, this movement of the foot causes force to be applied to the upper body and transmitted through the portion of the upper body that receives this force, one of the support members that is fixed to the upper body, the shoelace, the other of the support members, and the portion of the upper body that is fixed to the other support member. Thus, not only the portion of the upper body that receives the force but also the portion of the upper body on the opposite side of the portion receiving this force follows the movement of the foot, and accordingly, both the medial foot-side portion and the lateral foot-side portion of the upper body keep the state in which the foot is held moderately. Thereby, the dynamic fit is enhanced.

CITATION LIST

Patent Literature

PTL 1: International Publication No. 2020/202322

SUMMARY OF INVENTION

Technical Problem

In the case of the shoe disclosed in PTL 1, the dynamic fit is significantly improved, but the stationary fit cannot always be sufficiently ensured. In other words, as described above, the compression by the shoe onto the foot needs to be reduced in order to enhance the stationary fit. However, when the upper body is formed of a highly stretchable member in order to significantly improve the stationary fit in the shoe disclosed in PTL 1, the rigidity of the upper body still becomes insufficient, with the result that the dynamic fit to be improved becomes poor.

Thus, the present invention has been made in view of the above-described problems, and aims at providing a shoe exhibiting excellent performance for both a stationary fit and a dynamic fit.

Solution to Problem

A shoe according to the present invention includes: an upper body provided with a top opening into which a foot of a wearer is inserted, and a central opening extending from the top opening toward a front side in a front-rear direction corresponding to a foot length direction of the foot of the wearer; a shoe tongue disposed inside the upper body to cover the central opening from inside the upper body; and a shoelace for tightening a portion of the upper body in a left-right direction corresponding to a foot width direction of the foot of the wearer, the portion of the upper body defining the central opening. The upper body includes a first wall portion and a second wall portion as a pair of side wall portions facing each other in the left-right direction, and the top opening and the central opening are defined by a top end portion of the first wall portion and a top end portion of the second wall portion. The shoe tongue includes a cover portion that covers the central opening, and a first extending portion extending from an end portion of the cover portion on a side close to the first wall portion toward a bottom end portion of the first wall portion along an inner surface of the first wall portion, the first extending portion having a lower end, the lower end being fixed. The first extending portion is made of a material higher in stretchability than a material forming the first wall portion. A portion defining the central opening in the top end portion of the first wall portion is provided with at least one upper body-side first shoelace passing-through portion through which the shoelace is inserted from a side of the second wall portion and folded back, and the shoe tongue is provided with at least one shoe tongue-side first shoelace passing-through portion through which the shoelace is inserted from a side of the second wall portion and folded back.

Advantageous Effects of Invention

According to the present invention, a shoe exhibiting excellent performance for both a stationary fit and a dynamic fit can be provided.

DESCRIPTION OF EMBODIMENTS

Figure 1:
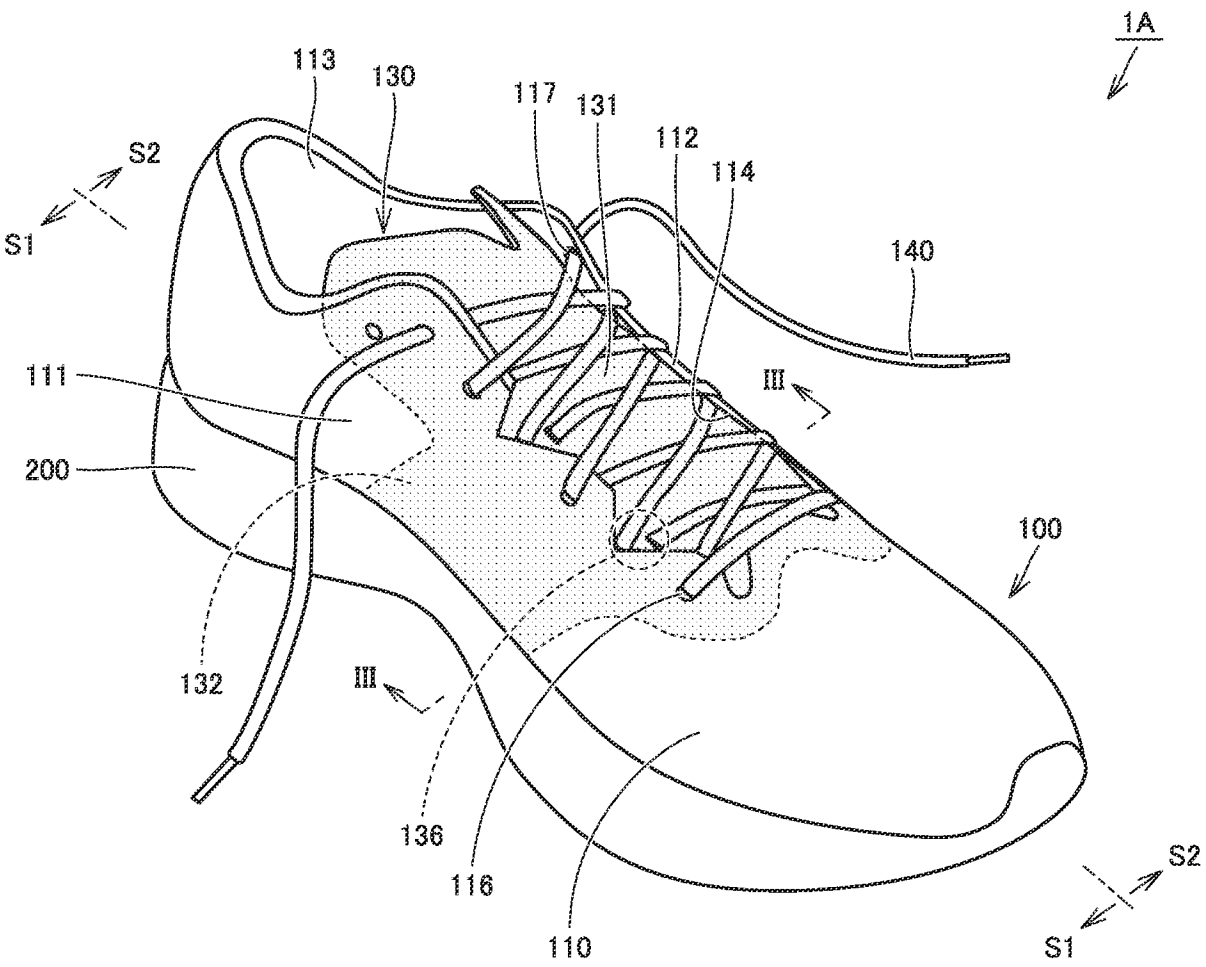
FIG. 1 is a perspective view of a shoe according to a first embodiment.

The following describes embodiments of the present invention in detail with reference to the accompanying drawings. In the embodiments described below, the same or corresponding portions are denoted by the same reference characters, and the description thereof will not be repeated.

First Embodiment

Figure 2:
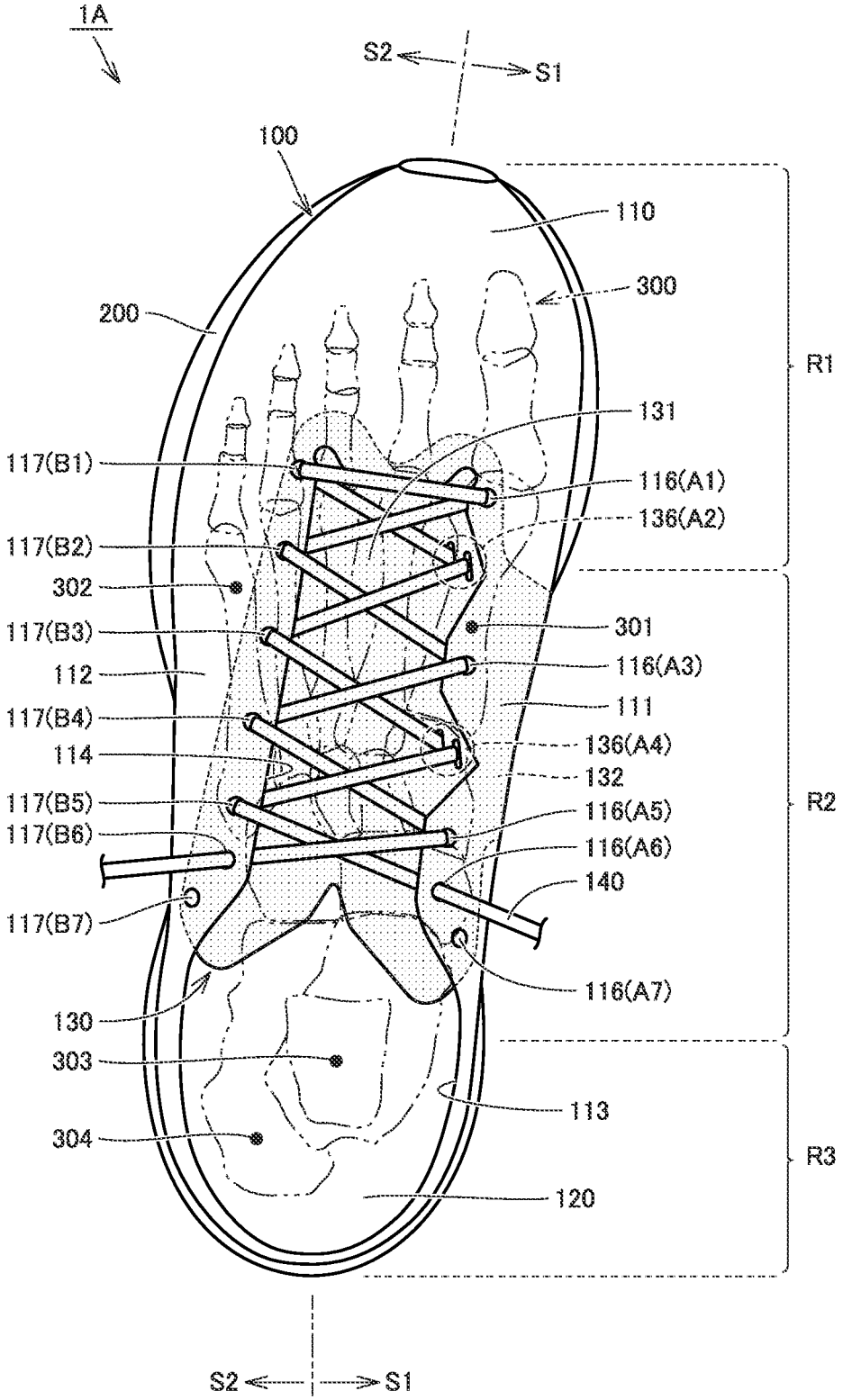
FIG. 2 is a plan view of the shoe shown in FIG. 1.
Figure 3:
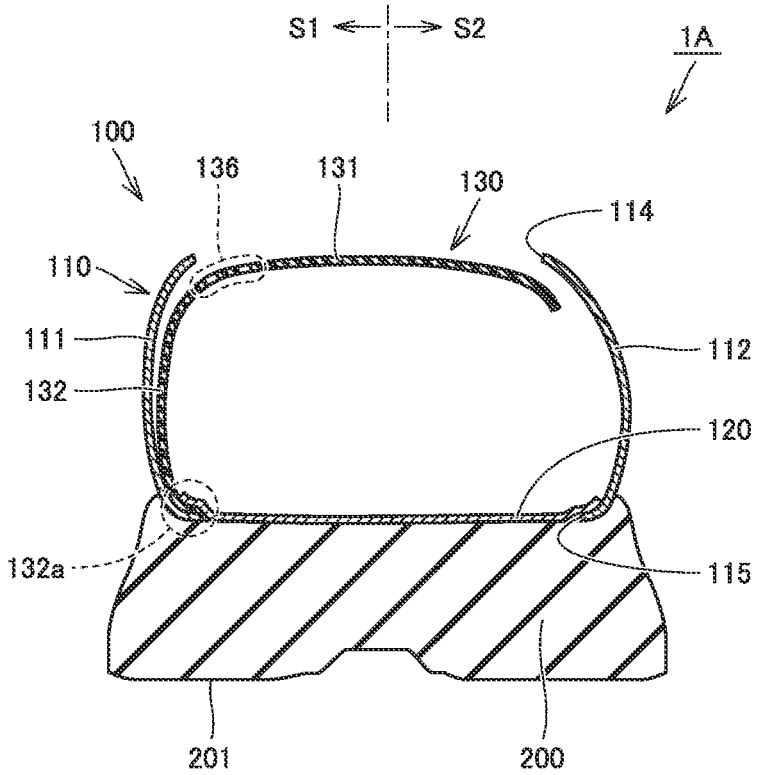
FIG. 3 is a cross-sectional view of the shoe shown in FIG. 1.
Figure 4:
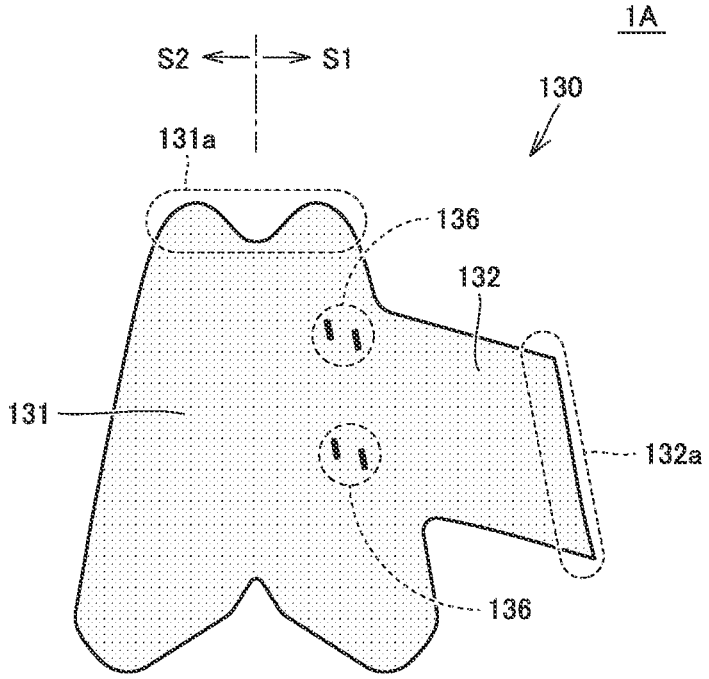
FIG. 4 is a plan view of a shoe tongue shown in FIG. 1 in a developed state.

FIG. 1 is a perspective view of a shoe according to the first embodiment, and FIG. 2 is a plan view of the shoe shown in FIG. 1. FIG. 3 is a cross-sectional view showing the shoe and taken along a line in FIG. 1, and FIG. 4 is a plan view of a shoe tongue shown in FIG. 1 in a developed state. Referring to FIGS. 1 to 4, the following describes a shoe 1A according to the present embodiment. Note that a wearer is assumed to be a person who has a standard physique having feet conforming to the size of the shoes. In FIG. 2, bones 300 of a foot are superimposed on the shoe 1A so as to allow clear understanding of the positional relation between the shoe and the bones of the foot of the wearer wearing the shoe.

As shown in FIGS. 1 to 3, the shoe 1A includes an upper 100 and a sole 200. The sole 200 is a member that supports a sole of a foot of a wearer and has a substantially flat shape. The upper 100 has a bag-like shape enclosing substantially entirely the inserted foot of the wearer and is located above the sole 200.

As shown in FIG. 2, the shoe 1A is divided into a portion on the medial foot side (a portion on the S1 side shown in FIG. 2) and a portion on the lateral foot side (a portion on the S2 side shown in FIG. 2) in a left-right direction (substantially in the left-right direction in FIG. 2) corresponding to the foot width direction of the wearer's foot in a plan view. In this case, the portion on the medial foot side corresponds to the medial side of the foot in anatomical position (i.e., the side close to the midline) and the portion on the lateral foot side is opposite to the medial side of the foot in anatomical position (i.e., the side away from the midline).

Further, the shoe 1A is divided into a forefoot portion R1, a midfoot portion R2, and a rearfoot portion R3 in a front-rear direction (substantially in an up-down direction in FIG. 2) corresponding to a foot length direction of the wearer's foot in a plan view. The forefoot portion R1 is located at a position corresponding to a toe portion and a ball portion of the wearer's foot, the midfoot portion R2 is located at a position corresponding to an arch portion of the wearer's foot, and the rearfoot portion R3 is located at a position corresponding to a heel portion of the wearer's foot.

In this case, with respect to the front end of the shoe 1A, a first boundary position is defined at a position located at 40% of the dimension of the shoe 1A from the front end in the front-rear direction, and a second boundary position is defined at a position located at 80% of the dimension of the shoe 1A from the front end in the front-rear direction. In this case, the forefoot portion R1 corresponds to a portion included between the front end and the first boundary position in the front-rear direction, the midfoot portion R2 corresponds to a portion included between the first boundary position and the second boundary position in the front-rear direction, and the rearfoot portion R3 corresponds to a portion included between the second boundary position and the rear end of the shoe 1A in the front-rear direction.

As shown in FIGS. 1 to 3, the upper 100 includes an upper body 110, an insole 120, a shoe tongue 130, and a shoelace 140. The upper body 110 is shaped to substantially cover a portion of the wearer's foot excluding the sole of the foot. The insole 120, the shoe tongue 130, and the shoelace 140 each are fixed or attached to the upper body 110.

In FIGS. 1 and 2 and FIG. 4 (referred to later), the shoe tongue 130 is shown in light color in order to facilitate understanding. Particularly in FIGS. 1 and 2, in order to allow understanding of the arrangement position of the shoe tongue 130 with respect to the entire shoe 1A, the above-mentioned light color is applied not only in a portion of the shoe tongue 130 that is visible from outside, but also in a portion of the shoe tongue 130 that is invisible from outside since it is covered by the upper body 110, the shoelace 140, and the like. From a similar viewpoint, the same coloring is applied in the same type of figures referred to in various modifications and other embodiments, which will be described later.

The upper body 110 includes a medial foot-side wall portion 111 as the first wall portion and a lateral foot-side wall portion 112 as the second wall portion. The medial foot-side wall portion 111 corresponds to a portion located on the medial foot side (i.e., the S1 side shown in the figure) of the upper body 110, and the lateral foot-side wall portion 112 corresponds to a portion located on the lateral foot side (i.e., the S2 side shown in the figure) of the upper body 110. The medial foot-side wall portion 111 and the lateral foot-side wall portion 112 are located to face each other in the left-right direction of the shoe 1A, and constitute a pair of side wall portions of the upper body 110.

A top opening 113 and a central opening 114 are provided in an upper portion of the upper body 110. The top opening 113, into which the wearer's foot is inserted, is located to extend over the midfoot portion R2 and the rearfoot portion R3. The central opening 114 extends from the top opening 113 frontward in the front-rear direction, and is located to extend over the forefoot portion R1 and the midfoot portion R2 so as to be disposed in a portion corresponding to the instep of the wearer's foot. The top opening 113 and the central opening 114 each are defined by a top end portion of the medial foot-side wall portion 111 and a top end portion of the lateral foot-side wall portion 112.

A lower opening 115 (see FIG. 3) is provided in a lower portion of the upper body 110. The lower opening 115 is located to extend from the forefoot portion R1 through the midfoot portion R2 to the rearfoot portion R3 so as to be disposed in a portion corresponding to the entire sole of the wearer's foot. The lower opening 115 is defined by a bottom end portion of the medial foot-side wall portion 111 and a bottom end portion of the lateral foot-side wall portion 112.

The insole 120 has a sheet shape and closes the lower opening 115 of the upper body 110. More specifically, in the state in which the insole 120 is disposed to cover the lower opening 115 of the upper body 110, the peripheral edge of the insole 120 is joined to the upper body 110 at the bottom end portion of the medial foot-side wall portion 111 and the bottom end portion of the lateral foot-side wall portion 112, so that the insole 120 is fixed to the upper body 110. The insole 120 can be joined to the upper body 110, for example, by sewing, welding, bonding, or a combination thereof.

The shoe tongue 130 has a sheet shape and is disposed inside the upper body 110. More specifically, the shoe tongue 130 is located so as to cover the central opening 114 from inside, and is joined at its prescribed portion to the upper body 110 and thereby fixed to the upper body 110. The shoe tongue 130 can be joined to the upper body 110, for example, by sewing, welding, bonding, or a combination thereof. Note that the detailed configuration of the shoe tongue 130 will be specifically described later.

Thus, the upper body 110, the insole 120, and the shoe tongue 130 are combined, so that the upper 100 has a bag-like shape as described above and thereby can enclose substantially entirely the inserted wearer's foot.

Examples of the materials for the upper body 110, the insole 120, and the shoe tongue 130 include woven fabric, knitted fabric, natural leather, artificial leather, and the like. Among them, woven fabric and knitted fabric are formed using fabric woven or knitted with synthetic resin yarns such as polyester yarns, nylon yarns, or thermoplastic polyurethane (TPU) yarns. For shoes particularly required to be air permeable and lightweight, a double raschel warp knitted fabric interwoven with polyester yarns is suitably used. In this case, the upper body 110, the insole 120, and the shoe tongue 130 are not necessarily made of the same material, but may be made of different materials.

The shoelace 140 is a member for tightening by pulling the peripheral edge of the central opening 114 (i.e., the top end portion of the medial foot-side wall portion 111 and the top end portion of the lateral foot-side wall portion 112) provided in the upper body 110 to be gathered in the left-right direction. More specifically, the shoelace 140 is inserted through shoelace passing-through portions 116 and 117 (described later) provided in the upper body 110 and a shoelace passing-through portion 136 provided in the shoe tongue 130. Thus, when the shoelace 140 is tightened, the upper body 110 and the shoe tongue 130 receive the tightening force of the shoelace 140 and thereby come into close contact with the wearer's foot.

Although the material of the shoelace 140 is not particularly limited, the shoelace 140 is preferably formed of a string-like member, for example, made of woven fabric, knitted fabric, natural leather, artificial leather, or the like.

On the other hand, the sole 200 having a substantially flat shape as described above has an upper surface joined and thereby fixed to the upper 100 (more specifically, the bottom end portion of the upper body 110 and the insole 120) and also has a lower surface configured as a ground contact surface 201 (see FIG. 3). The sole 200 can be joined to the upper 100, for example, by bonding or the like.

Although the configuration of the sole 200 is not particularly limited, the sole 200 is typically formed, for example, of a member having a two-layer structure of a midsole and an outsole.

The midsole forms an upper layer portion of the sole 200 and is formed of a member excellent in shock absorbing performance while having proper strength. From this viewpoint, the midsole is formed using, for example, a resin-made foam material containing: a resin material as a main component; and a foaming agent and a cross-linking agent as sub-components. Alternatively, the midsole may be formed using a rubber-made foam material containing a rubber material as a main component; and a plasticizer, a foaming agent, a reinforcing agent, and a cross-linking agent as sub-components.

The outsole forms a lower layer portion of the sole 200 and is formed of a member excellent in wear resistance and grip performance From this viewpoint, the outsole is formed using a member, for example, made of a material containing: a rubber material as a main component; and a plasticizer, a reinforcing agent, and a cross-linking agent as subcomponents.

The midsole and the outsole are joined, for example, by bonding or the like and thereby fixed. The midsole may include various types of shock absorbing parts and reinforcing parts at its prescribed portions. Further, the lower surface of the outsole is configured as the above-mentioned ground contact surface 201. Thus, in order to improve grip performance, the exposed surface of this lower surface may be provided with protrusions and recesses so as to form a tread pattern.

As shown in FIGS. 1 to 4, in the shoe 1A according to the present embodiment, the shoe tongue 130 includes a cover portion 131 and a medial foot-side extending portion 132 as the first extending portion. The cover portion 131 and the medial foot-side extending portion 132 are configured by prescribed portions of the shoe tongue 130 formed of a single member.

The cover portion 131 corresponds to a portion of the shoe tongue 130 that covers the central opening 114 of the upper body 110 and the peripheral edge of the central opening 114, and has a substantially trapezoidal shape having a top base and a bottom base each provided with a slit in a plan view. Note that the shape of the cover portion 131 is not limited thereto and may be any shape.

The cover portion 131 has a front end including a fixing portion 131*a* (see FIG. 4) that is joined to a portion of the upper body 110 that defines the front end portion of the central opening 114, for example, by sewing, welding, bonding, or a combination thereof.

The medial foot-side extending portion 132 is formed of a strip-shaped portion extending from the peripheral edge of the cover portion 131 toward the medial foot side of the shoe 1A (i.e., toward the S1 side shown in the figure). The medial foot-side extending portion 132 extends from the peripheral edge of the cover portion 131 in this way, and thereby, is located to extend along the inner surface of the medial foot-side wall portion 111 of the upper body 110 toward the bottom end portion of the medial foot-side wall portion 111.

The medial foot-side extending portion 132 has a lower end including a fixing portion 132*a* (see FIGS. 3 and 4) that is joined to the bottom end portion of the medial foot-side wall portion 111 of the upper body 110, for example, by sewing, welding, bonding, or a combination thereof. Note that the fixing portion 132*a* of the medial foot-side extending portion 132 may be fixed to the upper body 110 as well as the insole 120 fixed to the upper body 110, may be fixed only to the insole 120, or may be fixed only to the upper body 110 separately from the insole 120. Further, the fixing portion 132*a* of the medial foot-side extending portion 132 may be fixed to the sole 200.

In this case, the above-mentioned single member forming the shoe tongue 130 is made of a material higher in stretchability than the material forming the upper body 110. Thus, in the portion on the medial foot side (i.e., on the S1 side shown in the figure) of the shoe 1A, the medial foot-side wall portion 111 of the upper body 110 and the medial foot-side extending portion 132 of the shoe tongue 130 are arranged to overlap with each other such that the medial foot-side wall portion 111 made of a relatively low stretchable and relatively highly rigid material is located on the outer side while the medial foot-side extending portion 132 made of a relatively highly stretchable and relatively low rigid material is located on the inner side.

Further, in the cover portion 131 of the shoe tongue 130, a portion closer to the medial foot-side extending portion 132 is provided with a plurality of shoelace passing-through portions 136 each as a shoe tongue-side first shoelace passing-through portion. Each of these shoelace passing-through portions 136, through which the shoelace 140 is inserted, is formed of a pair of through holes provided in the cover portion 131.

In this case, each of the plurality of shoelace passing-through portions 136 is formed of a pair of through holes for the purpose of allowing the shoelace 140 inserted into one through hole from the upper surface side of the shoe tongue 130 to be folded back on the lower surface side of the shoe tongue 130 and then inserted into the other through hole, to thereby allow the shoelace 140 to be pulled out again to the upper surface side of the shoe tongue 130.

It is preferable that one of the pair of through holes is located to be more inward in the left-right direction of the shoe 1A and more forward in the front-rear direction of the shoe 1A than the other of the pair of through holes. By the configuration as described above, the folded shoelace 140 does not overlap with itself in the portion where the shoelace 140 is folded back, or even if the folded shoelace 140 overlaps with itself, the overlapping area can be reduced.

Thus, the configuration as described above makes it possible to reduce the feeling of contact that the wearer's foot receives from the folded-back portion of the shoelace 140, which enables a more excellent fit to the wearer's foot. Note that it is particularly effective to employ the above-described configuration since each of the shoelace passing-through portions 136 provided in the shoe tongue 130 is provided at a position closer to the wearer's foot than each of the shoelace passing-through portions 116 (described later) provided in the upper body 110.

The plurality of shoelace passing-through portions 136 are disposed at prescribed positions in the cover portion 131 so as to be located along a top end portion of the medial foot-side wall portion 111 of the upper body 110 as described later. In the present embodiment, a total of two shoelace passing-through portions 136 are provided as shown in the figure.

Further, as shown in FIGS. 1 and 2, in the shoe 1A according to the present embodiment, a plurality of shoelace passing-through portions 116 as upper-side first shoelace passing-through portions are provided in the top end portion of the medial foot-side wall portion 111 of the upper body 110. Each of these shoelace passing-through portions 116, through which the shoelace 140 is inserted, is formed of a single through hole provided in the upper body 110.

The plurality of shoelace passing-through portions 116 are arranged side by side in the front-rear direction along the top end portion of the medial foot-side wall portion 111 of the upper body 110. In the present embodiment, as shown in the figures, a total of five shoelace passing-through portions 116 are provided, including what is called an extra hole (i.e., one additional shoelace passing-through portion 116 provided on the rearmost side in the front-rear direction in order to adjust the length of the knot of the shoelace 140).

On the other hand, in the shoe 1A according to the present embodiment, a plurality of shoelace passing-through portions 117 are provided in the top end portion of the lateral foot-side wall portion 112 of the upper body 110. Each of these shoelace passing-through portions 117, through which the shoelace 140 is inserted, is formed of a single through hole provided in the upper body 110.

The plurality of shoelace passing-through portions 117 are arranged side by side in the front-rear direction along the top end portion of the lateral foot-side wall portion 112 of the upper body 110. In the present embodiment, as shown in the figures, a total of seven shoelace passing-through portions 117 are provided, including what is called an extra hole.

By the configuration as described above, in the shoe 1A according to the present embodiment, the medial foot-side portion of the upper 100 is provided with a total of seven shoelace passing-through portions located substantially linearly side by side in the front-rear direction, and the lateral foot-side portion of the upper 100 is provided with a total of seven shoelace passing-through portions located substantially linearly side by side in the front-rear direction.

Then, referring to FIG. 2, reference numerals A1 to A7 are assigned in order from the front side to the rear side in the front-rear direction to the medial foot-side shoelace passing-through portions, specifically, a total of seven shoelace passing-through portions arranged in the medial foot-side portion of the upper body 110. In this case, in the shoe 1A according to the present embodiment, the medial foot-side shoelace passing-through portions A1, A3, and A5 to A7 are configured of the shoelace passing-through portions 116 provided in the top end portion of the medial foot-side wall portion 111 of the upper body 110, and the medial foot-side shoelace passing-through portions A2 and A4 are configured of the shoelace passing-through portions 136 provided in the cover portion 131 of the shoe tongue 130.

Further, in the shoe 1A according to the present embodiment, a notch having a V-shape in a plan view is provided in the top end portion of the medial foot-side wall portion 111 of the upper body 110 in a portion corresponding to each shoelace passing-through portion 136 provided in the shoe tongue 130, so that the shoelace passing-through portion 136 is disposed inside the notch. By the configuration as described above, a total of seven medial foot-side shoelace passing-through portions A1 to A7 are arranged substantially linearly side by side in the front-rear direction.

On the other hand, referring to FIG. 2, reference numerals B1 to B7 are assigned in order from the front side to the rear side in the front-rear direction to the lateral foot-side shoelace passing-through portions, specifically, a total of seven shoelace passing-through portions arranged in the lateral foot-side portion of the upper body 110. In this case, in the shoe 1A according to the present embodiment, the lateral foot-side shoelace passing-through portions B1 to B7 are configured of the shoelace passing-through portions 117 provided in the top end portion of the lateral foot-side wall portion 112 of the upper body 110.

The shoelace 140 is inserted in prescribed order through the medial foot-side shoelace passing-through portions A1 to A7 and the lateral foot-side shoelace passing-through portions B1 to B7. However, in the state shown in FIG. 2, an extra hole A7 among the medial foot-side shoelace passing-through portions A1 to A7 and an extra hole B7 among the lateral foot-side shoelace passing-through portions B1 to B7 are not used.

In this case, starting from one end portion pulled out to the medial foot side to the other end portion pulled out to the lateral foot side, the shoelace 140 having this pair of end portions extending in the length direction is passed through the shoelace passing-through portions in order of the medial foot-side shoelace passing-through portion A6, the lateral foot-side shoelace passing-through portion B5, the medial foot-side shoelace passing-through portion A4, the lateral foot-side shoelace passing-through portion B3, the medial foot-side shoelace passing-through portion A2, the lateral foot-side shoelace passing-through portion B1, the medial foot-side shoelace passing-through portion A1, the lateral foot-side shoelace passing-through portion B2, the medial foot-side shoelace passing-through portion A3, the lateral foot-side shoelace passing-through portion B4, the medial foot-side shoelace passing-through portion A5, and the lateral foot-side shoelace passing-through portion B6.

Thus, when attention is paid to the medial foot-side shoelace passing-through portions A1 to A6, from the lateral foot side (i.e., the S2 side shown in the figure), the shoelace 140 is inserted and folded back through each of the plurality of shoelace passing-through portions 116 (i.e., each of the medial foot-side shoelace passing-through portions A1, A3, A5, and A6) provided in the upper body 110. Also, from the lateral foot side (i.e., the S2 side shown in the figure), the shoelace 140 is inserted and folded back through each of the plurality of shoelace passing-through portions 136 (i.e., each of the medial foot-side shoelace passing-through portions A2 and A4) provided in the shoe tongue 130.

On the other hand, when attention is paid to the lateral foot-side shoelace passing-through portions B1 to B6, from the medial foot side (i.e., the S1 side shown in the figure), the shoelace 140 is inserted and folded back through each of the plurality of shoelace passing-through portions 117 (i.e., each of the lateral foot-side shoelace passing-through portions B1 to B6) provided in the upper body 110.

In this case, as described above, the lower end of the medial foot-side extending portion 132 of the shoe tongue 130 is fixed to the bottom end portion of the medial foot-side wall portion 111 of the upper body 110. Thus, in the portion including each shoelace passing-through portion 136 through which the shoelace 140 is inserted, the shoe tongue 130 receives the tightening force of the shoelace 140 and thereby is pulled toward the lateral foot side (i.e., toward the S2 side shown in the figure), so that the medial foot-side portion of the shoe tongue 130 is brought into close contact with the wearer's foot.

As described above, the shoe tongue 130 is made of a material higher in stretchability than the material of the upper body 110. Thus, at this time, the medial foot-side portion of the shoe tongue 130 comes into close contact with the wearer's foot while being stretched in the circumferential direction of the wearer's foot. Accordingly, during a low-intensity exercise, the feeling of restraint by the shoe 1A is reduced and the shoe 1A is appropriately fitted to the wearer's foot, with the result that what is called a stationary fit is improved.

On the other hand, in the portion including each shoelace passing-through portion 116 through which the shoelace 140 is inserted, the medial foot-side wall portion 111 of the upper body 110 receives the tightening force of the shoelace 140 and thereby is pulled toward the lateral foot side (i.e., toward the S2 side shown in the figure), so that the medial foot-side wall portion 111 is brought into close contact with the wearer's foot. Further, in the portion including each shoelace passing-through portion 117 through which the shoelace 140 is inserted, the lateral foot-side wall portion 112 of the upper body 110 receives the tightening force of the shoelace 140 and thereby is pulled toward the medial foot side (i.e., toward the S1 side shown in the figure), so that the lateral foot-side wall portion 112 is brought into close contact with the wearer's foot.

As described above, the upper body 110 is made of a material higher in rigidity than the material of the shoe tongue 130. Thus, at this time, the medial foot-side wall portion 111 and the lateral foot-side wall portion 112 are hardly stretched but tightened so as to collapse inward. Accordingly, during a high-intensity exercise, the shoe 1A follows the movement of the foot to thereby keep the state in which the wearer's foot is appropriately held by the shoe 1A, with the result that what is called a dynamic fit is improved.

Therefore, by the shoe 1A according to the present embodiment as described above, excellent functions are exerted both in the stationary fit that is important during a low-intensity exercise and the dynamic fit that is important during a high-intensity exercise. Thereby, a shoe balanced between the stationary fit and the dynamic fit can be obtained.

Further, as described above, the shoe 1A according to the present embodiment adopts the configuration in which, in the portion on the medial foot side (i.e., the S1 side shown in the figure), the medial foot-side extending portion 132 made of a relatively low rigid material in the shoe tongue 130 is disposed on the inner side of the medial foot-side wall portion 111 made of a relatively highly rigid material in the upper body 110. Thus, this medial foot-side extending portion 132 made of a low rigid material serves as a shock absorbing cushion to prevent the medial foot-side wall portion 111 made of a highly rigid material from directly contacting the wearer's foot. This also allows an improved fit to the wearer's foot.

Further, in the shoe 1A according to the present embodiment, the medial foot-side extending portion 132 of the shoe tongue 130 extends out from the cover portion 131 in the midfoot portion R2, and the lower end of the medial foot-side extending portion 132 is fixed to the bottom end portion of the medial foot-side wall portion 111 of the upper body 110 in the midfoot portion R2. The configuration as described above may also achieve an effect of pulling up a midfoot arch of the wearer's foot (i.e., the effect of suppressing occurrence of a phenomenon in which a long-term exercise or the like causes lowering of the midfoot arch).

In this case, the medial foot-side extending portion 132 of the shoe tongue 130 is preferably provided so as to cover a first metatarsal bone 301 of the wearer's foot. For example, by providing the medial foot-side extending portion 132 so as to cover at least the front end portion of the first metatarsal bone 301 (i.e., by providing the medial foot-side extending portion 132 so as to include a position ranging from the front end of the shoe to 30% to 40% of the dimension of the shoe in the front-rear direction with respect to the front end of the shoe), the stationary fit on the portion close to the forefoot portion R1 in the entire shoe can be improved. Further, by providing the medial foot-side extending portion 132 so as to cover at least the central portion of the first metatarsal bone 301 (i.e., by providing the medial foot-side extending portion 132 so as to include a position ranging from the front end of the shoe to 35% to 45% of the dimension of the shoe in the front-rear direction with respect to the front end of the shoe), the stationary fit on the midfoot portion R2 in the entire shoe can be improved. Further, by providing the medial foot-side extending portion 132 so as to cover at least the rear end portion of the first metatarsal bone 301 (i.e., by providing the medial foot-side extending portion 132 so as to include a position ranging from the front end of the shoe to 45% to 55% of the dimension of the shoe in the front-rear direction with respect to the front end of the shoe), the stationary fit on the portion close to the rearfoot portion R3 in the entire shoe can be improved.

The aforementioned present embodiment has exemplified the configuration in which the shoe tongue 130 is formed of a single member, and thus, the entire shoe tongue 130 including not only the medial foot-side extending portion 132 but also the cover portion 131 is formed of a material higher in stretchability than the material forming the medial foot-side wall portion 111 of the upper body 110. However, the shoe tongue 130 may be formed by a plurality of members integrated with each other. In that case, the above-described various effects can be achieved as long as at least the medial foot-side extending portion 132 is made of a material higher in stretchability than the material forming the medial foot-side wall portion 111.

Further, the aforementioned present embodiment has exemplified the configuration in which, among a total of seven medial foot-side shoelace passing-through portions, two of them are formed of the shoelace passing-through portions 136 provided in the shoe tongue 130. However, the total number of the medial foot-side shoelace passing-through portions is not particularly limited. Further, there is no particular limitation as to how many of the medial foot-side shoelace passing-through portions is/are to be formed of the shoelace passing-through portion 136 provided in the shoe tongue 130. Further, there is no particular limitation as to which one of the medial foot-side shoelace passing-through portions is to be formed of the shoelace passing-through portion 136 provided in the shoe tongue 130.

In this case, when two or more of the medial foot-side shoelace passing-through portions are formed of the shoelace passing-through portions 136 provided in the shoe tongue 130, it is preferable that the shoelace passing-through portions 116 provided in the upper body 110 and the shoelace passing-through portions 136 provided in the shoe tongue 130 are alternately arranged in the front-rear direction of the shoe. By the configuration as described above, the upper body 110 and the shoe tongue 130 can be equally tightened by the shoelace 140, so that a stationary fit and a dynamic fit can be further enhanced. Also in that case, the medial foot-side shoelace passing-through portion located on the foremost side is preferably one of the shoelace passing-through portions 116 provided in the upper body 110.

Further, the aforementioned present embodiment has exemplified the configuration in which the medial foot-side shoelace passing-through portions including the shoelace passing-through portion 116 provided in the upper body 110 and the shoelace passing-through portion 136 provided in the shoe tongue 130 are positioned substantially linearly side by side in the front-rear direction, but the present invention is not necessarily configured in this way. For example, when the shoelace 140 is formed of a member lower in stretchability than the member of the shoe tongue 130, each shoelace passing-through portion 136 provided in the shoe tongue 130 is disposed closer to the fixing portion 132*a* than each shoelace passing-through portion 116 provided in the upper body 110 (i.e., at a lower position closer to the medial foot side), and thereby, the above-mentioned effect of pulling up the midfoot arch of the wearer's foot can be enhanced. On the other hand, when the shoelace 140 is formed of a member higher in stretchability than the member of the shoe tongue 130, each shoelace passing-through portion 136 provided in the shoe tongue 130 is disposed on the side opposite to the fixing portion 132*a* with respect to each shoelace passing-through portion 116 provided in the upper body 110 (i.e., at a higher position closer to the lateral foot side), and thereby, the above-mentioned effect of pulling up the midfoot arch of the wearer's foot can be enhanced.

Further, the aforementioned present embodiment has exemplified the configuration in which a notch is provided in the medial foot-side wall portion 111 of the upper body 110 at a position corresponding to the portion where the shoelace passing-through portion 136 provided in the shoe tongue 130 is located, and thereby, this shoelace passing-through portion 136 is exposed to the outside. The present invention is however not necessarily configured in this way. In other words, it is not necessarily essential to provide a notch in the medial foot-side wall portion 111 of the upper body 110, and also not necessarily essential to expose the shoelace passing-through portion 136 provided in the shoe tongue 130 to the outside.

In the case where the shoelace passing-through portion 136 provided in the shoe tongue 130 is disposed closer to the fixing portion 132*a* (i.e., at a lower position closer to the medial foot side), the shoelace passing-through portion 136 may be provided not in the cover portion 131 but in the medial foot-side extending portion 132 in the shoe tongue 130.

Second Embodiment

Figure 5:
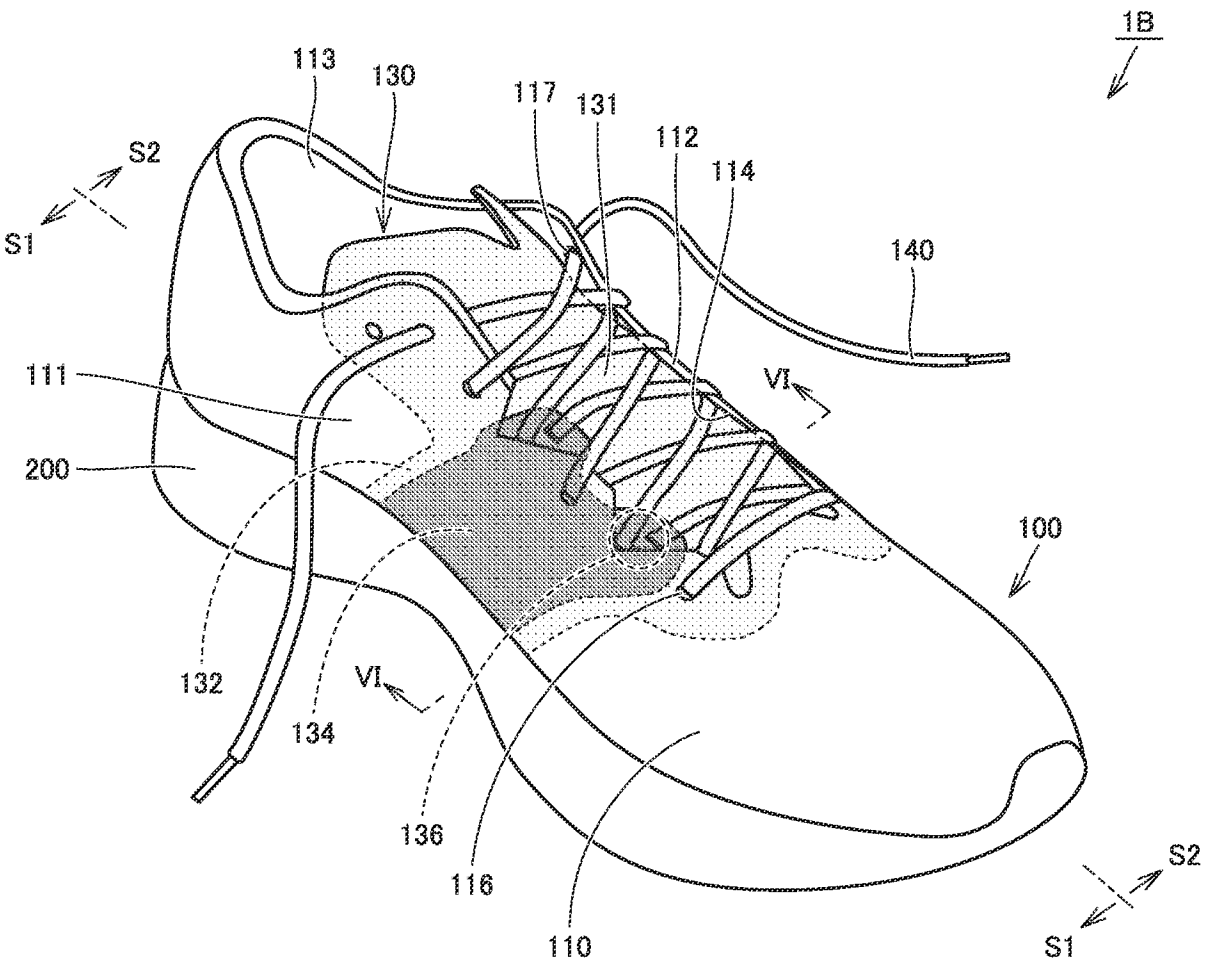
FIG. 5 is a perspective view of a shoe according to a second embodiment.
Figure 6:
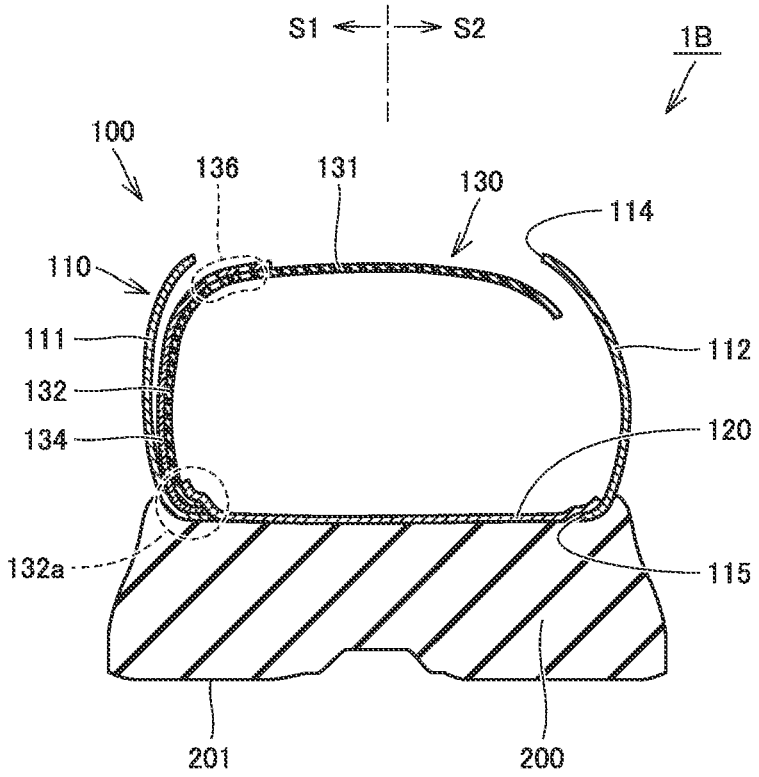
FIG. 6 is a cross-sectional view of the shoe shown in FIG. 5.
Figure 7:
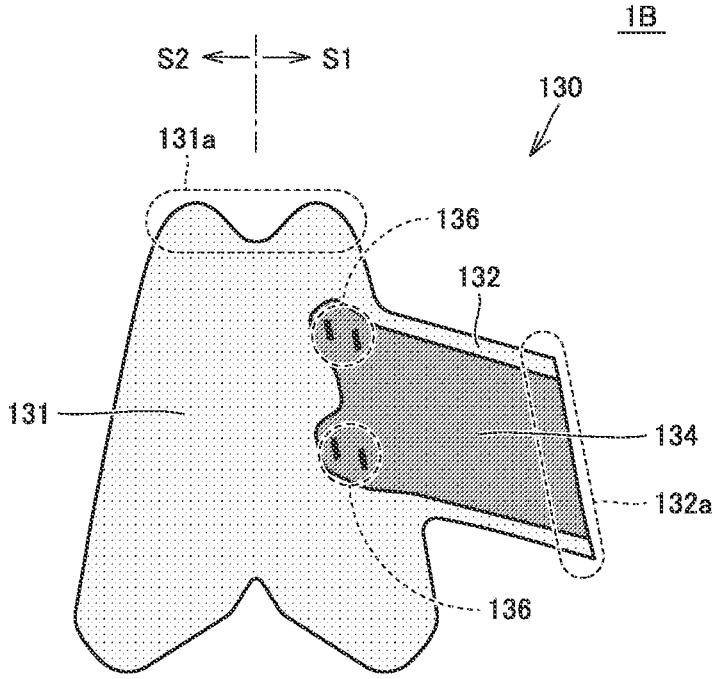
FIG. 7 is a plan view of a shoe tongue shown in FIG. 5 in a developed state.

FIG. 5 is a perspective view of a shoe according to the second embodiment. FIG. 6 is a cross-sectional view showing the shoe and taken along a line VI-VI in FIG. 5. FIG. 7 is a plan view of a shoe tongue shown in FIG. 5 in a developed state. Referring to these FIGS. 5 to 7, the following describes a shoe 1B according to the present embodiment.

As shown in FIGS. 5 to 7, the shoe 1B is different from the shoe 1A according to the first embodiment only in the configuration of the shoe tongue 130. Specifically, in the shoe 1B, the shoe tongue 130 has a medial foot-side reinforcing portion 134 as the first reinforcing portion.

In FIGS. 5 and 7, the medial foot-side reinforcing portion 134 of the shoe tongue 130 is shown in dark color in order to facilitate understanding. Particularly in FIG. 5, in order to allow understanding of the arrangement position of the medial foot-side reinforcing portion 134 with respect to the entire shoe 1B, the above-mentioned dark color is applied not only in a portion of the medial foot-side reinforcing portion 134 that is visible from outside, but also in a portion of the medial foot-side reinforcing portion 134 that is invisible from outside since it is covered by the upper body 110, the shoelace 140, and the like. From a similar viewpoint, the same coloring is applied in the same type of figures in various modifications and other embodiments, which will be described later.

The medial foot-side reinforcing portion 134 serves to mainly reinforce the medial foot-side extending portion 132 of the shoe tongue 130, and is provided so as to cover a prescribed portion on the upper surface of the medial foot-side extending portion 132. In the present embodiment, the medial foot-side reinforcing portion 134 is formed in a substantially rectangular shape in a plan view, and covers substantially the entire upper surface of the medial foot-side extending portion 132.

The medial foot-side reinforcing portion 134 is made of a material higher in stretchability than the material forming the upper body 110 and higher in rigidity than the material forming the medial foot-side extending portion 132 of the shoe tongue 130. Thus, in the portion on the medial foot side (i.e., the S1 side shown in the figure) of the shoe 1A including the medial foot-side reinforcing portion 134, specifically, the medial foot-side wall portion 111 of the upper body 110, the medial foot-side extending portion 132 of the shoe tongue 130, and the medial foot-side reinforcing portion 134 are arranged to overlap with each other such that the medial foot-side wall portion 111 made of a relatively low stretchable and relatively highly rigid material is located on the outermost side, the medial foot-side extending portion 132 made of a relatively highly stretchable and relatively low rigid material is located on the innermost side, and the medial foot-side reinforcing portion 134 made of a relatively moderately stretchable and rigid material is located between the medial foot-side wall portion 111 and the medial foot-side extending portion 132.

The medial foot-side reinforcing portion 134 can be formed, for example, of a TPU film, a mesh member, a rubber member, or the like, and is joined to the upper surface of the shoe tongue 130, for example, by bonding, sewing, welding, or a combination thereof. In other words, the medial foot-side reinforcing portion 134 is formed of a layered member so as to cover the surface of a prescribed portion of the shoe tongue 130.

In this case, the thickness of the layered medial foot-side reinforcing portion 134 is not particularly limited, but is, for example, 0.1 mm or more and 1.2 mm or less, and more suitably 0.3 mm or more and 0.7 mm or less. Further, the width of the medial foot-side reinforcing portion 134 in a plan view (i.e., the outer dimension in the direction orthogonal to the circumferential direction of the wearer's foot) is not particularly limited, but is preferably 10 mm or more.

In the configuration as described above, the durability of the shoe tongue 130 can be improved as compared with the case where the shoe tongue 130 is made only of a highly stretchable material. On the other hand, since the medial foot-side reinforcing portion 134 is made of a material higher in stretchability than the material of the medial foot-side wall portion 111 in the upper body 110, the stretchability of the entire shoe tongue 130 does not extremely decrease, and the medial foot-side extending portion 132 is appropriately stretched when the shoelace 140 is tightened.

In particular, when the medial foot-side reinforcing portion 134 is formed of a TPU film, a mesh member, a rubber member, or the like as described above, the medial foot-side reinforcing portion 134 has a property of being less likely to deform upon receiving instantaneous force, but being more likely to deform upon receiving continuous force, which is therefore extremely suitable for improving a stationary fit.

Therefore, the shoe 1B according to the present embodiment not only can achieve the balance between the stationary fit and the dynamic fit as in the first embodiment, but also can achieve further excellent durability.

In the shoe 1B according to the present embodiment, the medial foot-side reinforcing portion 134 covers substantially the entire upper surface of the medial foot-side extending portion 132 as described above, so that a particularly high stationary fit can be achieved.

In this case, the medial foot-side reinforcing portion 134 preferably extends in the direction in which the medial foot-side extending portion 132 extends (i.e., in the direction corresponding to the circumferential direction of the wearer's foot). This is because, when the shoelace 140 is tightened, or when the wearer's foot moves inside the shoe, the direction in which the medial foot-side extending portion 132 is mainly stretched corresponds to the direction in which the medial foot-side extending portion 132 extends. Thus, the medial foot-side reinforcing portion 134 extending in this direction can effectively reinforce the medial foot-side extending portion 132.

In addition, by the configuration as described above, during tightening of the shoelace 140, the tightening force of the shoelace 140 is appropriately transmitted to the medial foot-side extending portion 132 (i.e., the medial foot-side extending portion 132 is not stretched more than necessary), so that the effect of pulling up the midfoot arch of the wearer's foot can also be enhanced. Further, in addition to the medial foot-side wall portion 111, the medial foot-side reinforcing portion 134 having relatively high rigidity is located in the portion on the medial foot side (i.e., on the S1 side shown in the figure) of the shoe 1B, to thereby also improve a dynamic fit, which makes it also possible to suppress the wearer's foot from sliding sideways (i.e., suppress movement of the wearer's foot in the left-right direction of the shoe 1B).

Further, the lower end of the medial foot-side reinforcing portion 134 preferably reaches the fixing portion 132*a* of the medial foot-side extending portion 132 as shown in the figure. In the configuration as described above, the fixing portion 132*a* of the shoe tongue 130 including the lower end of the medial foot-side reinforcing portion 134 is fixed to the upper body 110, which makes it possible to enhance the fixing strength in the fixing portion 132*a*.

Further, the medial foot-side reinforcing portion 134 may be provided so as to reach the cover portion 131. In this case, the medial foot-side reinforcing portion 134 is preferably provided so as to cover the portion of the cover portion 131 where the shoelace passing-through portion 136 is provided as shown in the figure. By the configuration as described above, the shoelace passing-through portion 136 receiving the force applied by the shoelace 140 can also be simultaneously reinforced, so that the durability can be further improved.

In the shoe 1B according to the present embodiment, the medial foot-side reinforcing portion 134 is provided so as to cover the upper surface of the medial foot-side extending portion 132 and the upper surface of the cover portion 131, but may be provided so as to cover the lower surface of the medial foot-side extending portion 132 and the lower surface of the cover portion 131, or may be provided so as to cover the upper and lower surfaces of the medial foot-side extending portion 132 and the upper and lower surfaces of the cover portion 131.

First to Eighth Modifications

FIGS. 8 to 15 respectively show perspective views of shoes according to the first to eighth modifications. Referring to FIGS. 8 to 15, the following describes shoes 1B1 to 1B8 according to the first to eighth modifications based on the above-described second embodiment.

As shown in FIGS. 8 to 15, the shoes 1B1 to 1B8 are different from the shoe 1B according to the second embodiment only in the shape of the medial foot-side reinforcing portion 134 provided in the shoe tongue 130.

Figure 8:
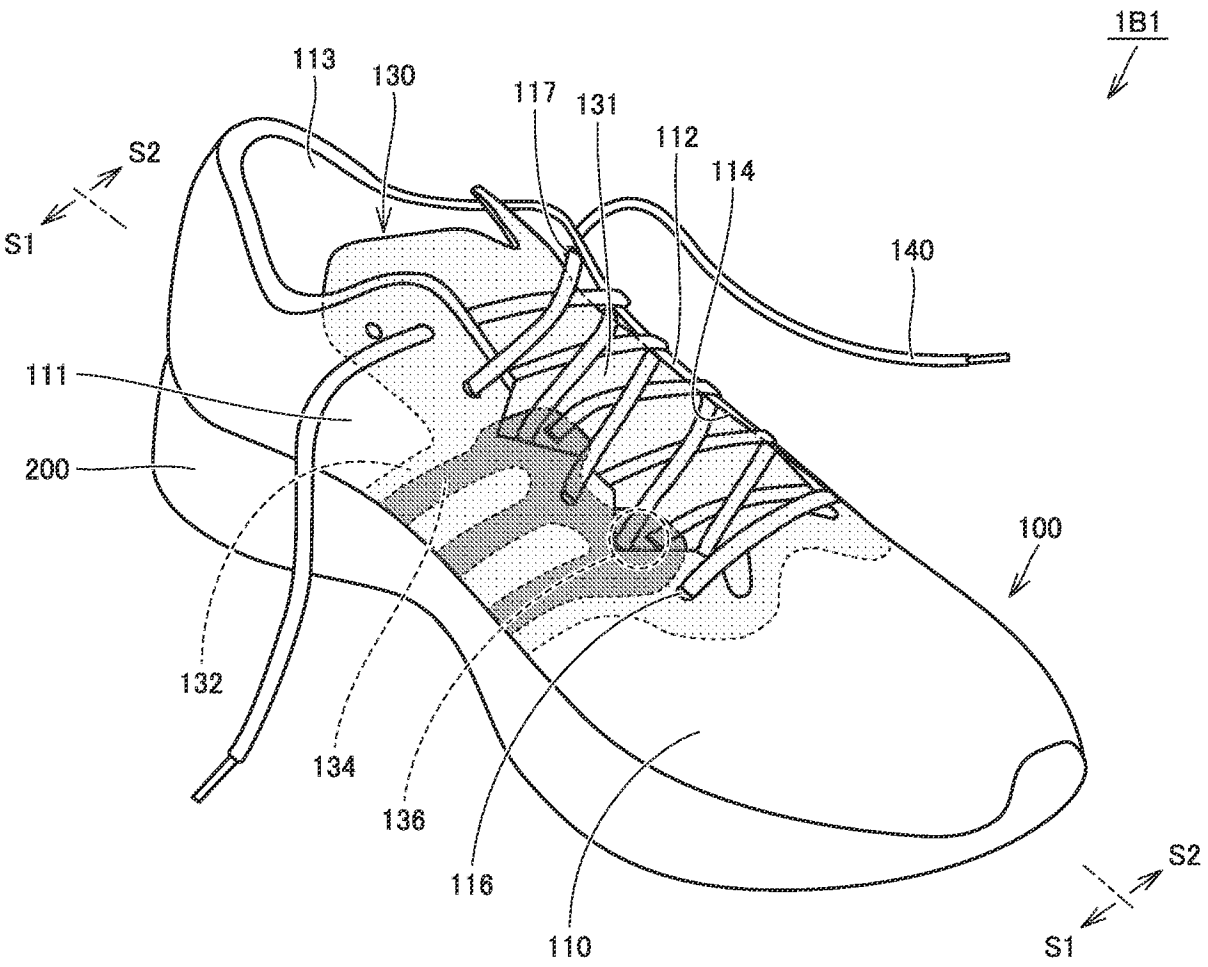
FIG. 8 is a perspective view of a shoe according to a first modification.

In the shoe 1B1 according to the first modification shown in FIG. 8, the medial foot-side reinforcing portion 134 has a substantially m-shape in a plan view. Such a configuration can also achieve substantially the same effect as that described in the aforementioned second embodiment. In the case where this configuration is adopted, the medial foot-side reinforcing portion 134 is smaller in size than that in the shoe 1B according to the second embodiment, by which the weight is reduced, and further, the shoe can be more readily fitted to the wearer's foot having a curved shape.

Figure 9:
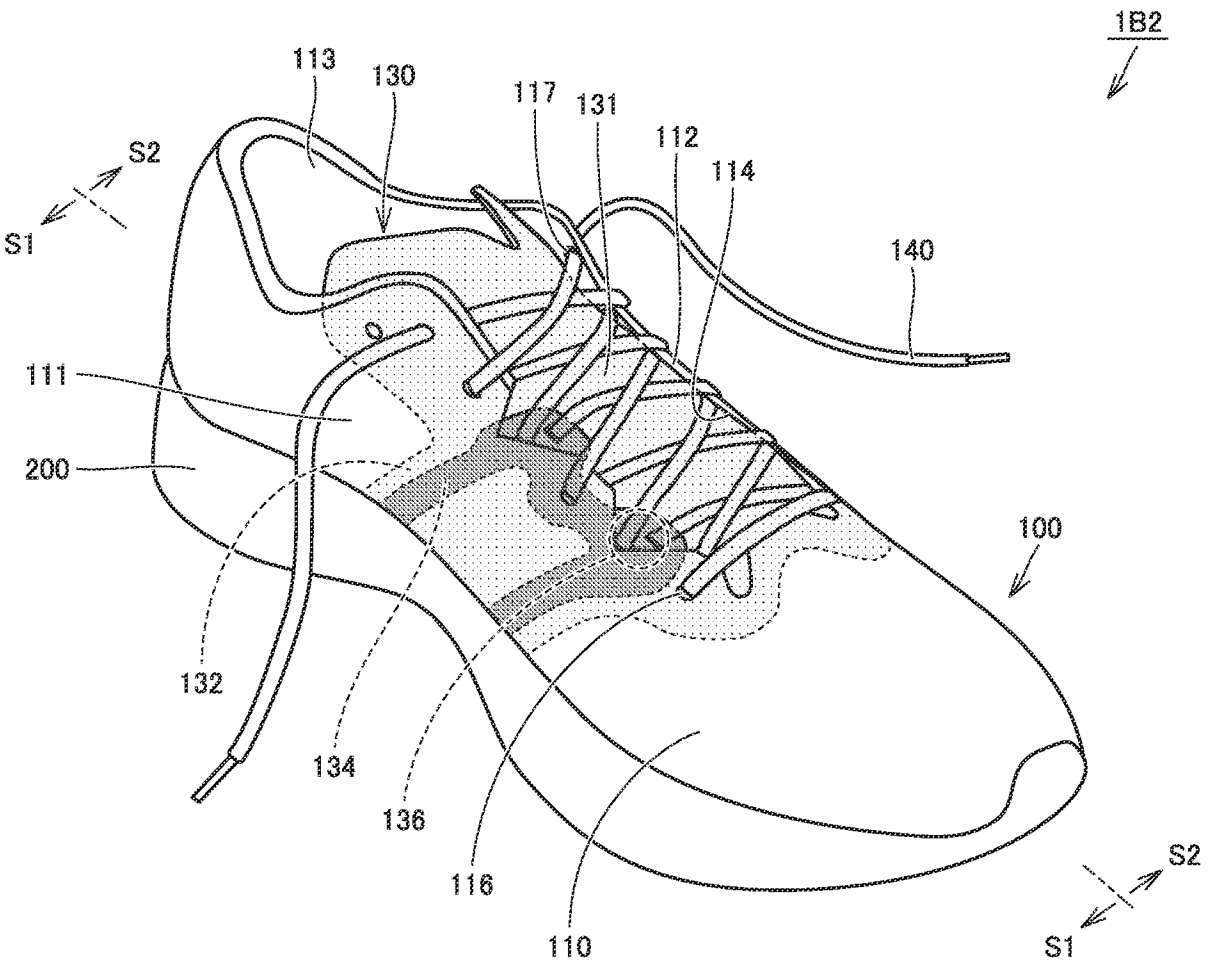
FIG. 9 is a perspective view of a shoe according to a second modification.

In the shoe 1B2 according to the second modification shown in FIG. 9, the medial foot-side reinforcing portion 134 has a substantially inverted U-shape in a plan view. Such a configuration can also achieve substantially the same effect as that described in the aforementioned second embodiment. In the case where this configuration is adopted, the medial foot-side reinforcing portion 134 is smaller in size than that in the shoe 1B according to the second embodiment, by which the weight is reduced, and further, the shoe can be more readily fitted to the wearer's foot having a curved shape.

Figure 10:
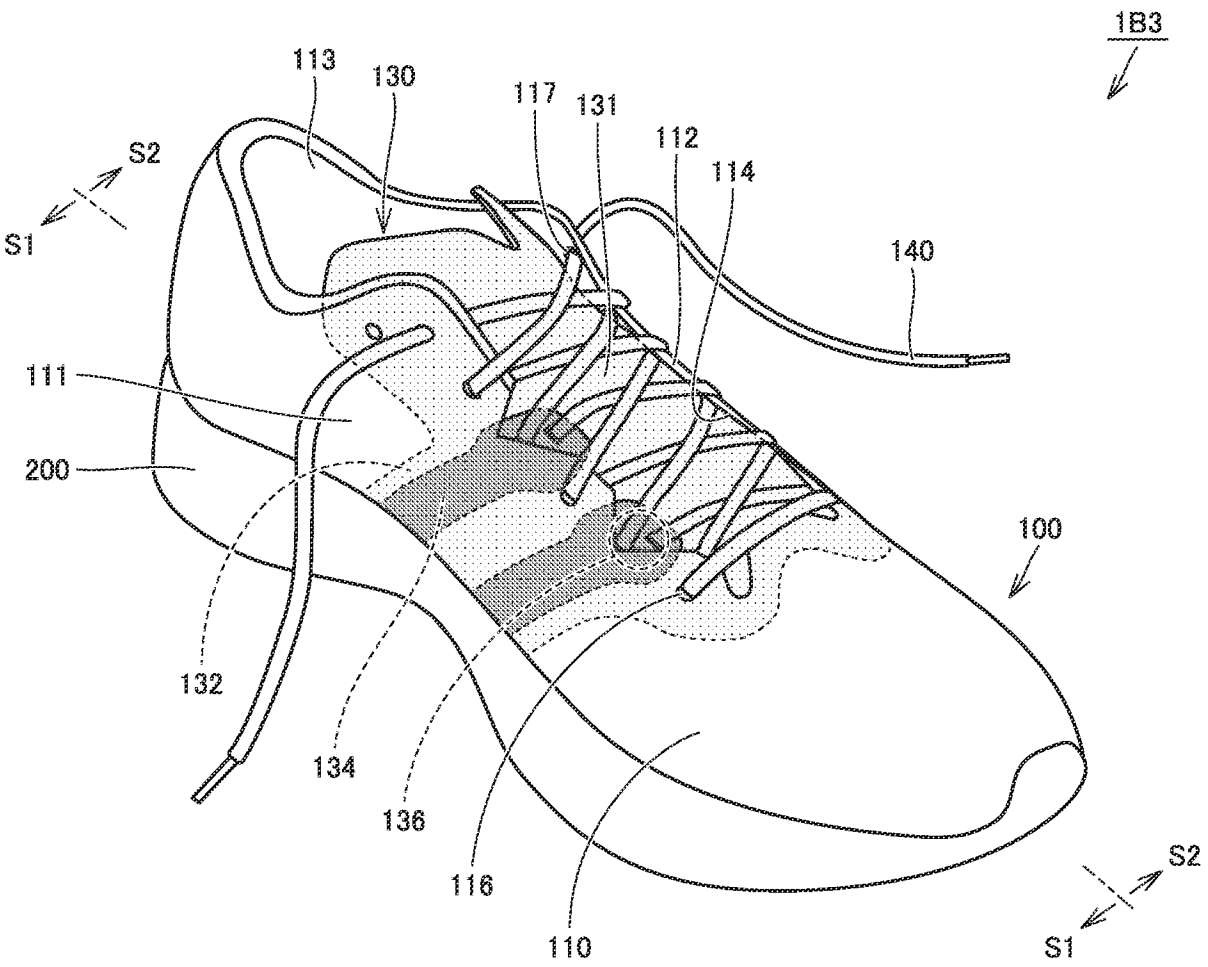
FIG. 10 is a perspective view of a shoe according to a third modification.

In the shoe 1B3 according to the third modification shown in FIG. 10, the medial foot-side reinforcing portion 134 is formed of two parts separated from each other and each having a substantially I-shape in a plan view. Such a configuration can also achieve substantially the same effect as that described in the aforementioned second embodiment. In the case where this configuration is adopted, the medial foot-side reinforcing portion 134 is smaller in size than that in the shoe 1B according to the second embodiment, by which the weight is reduced, and further, the shoe can be more readily fitted to the wearer's foot having a curved shape.

Figure 11:
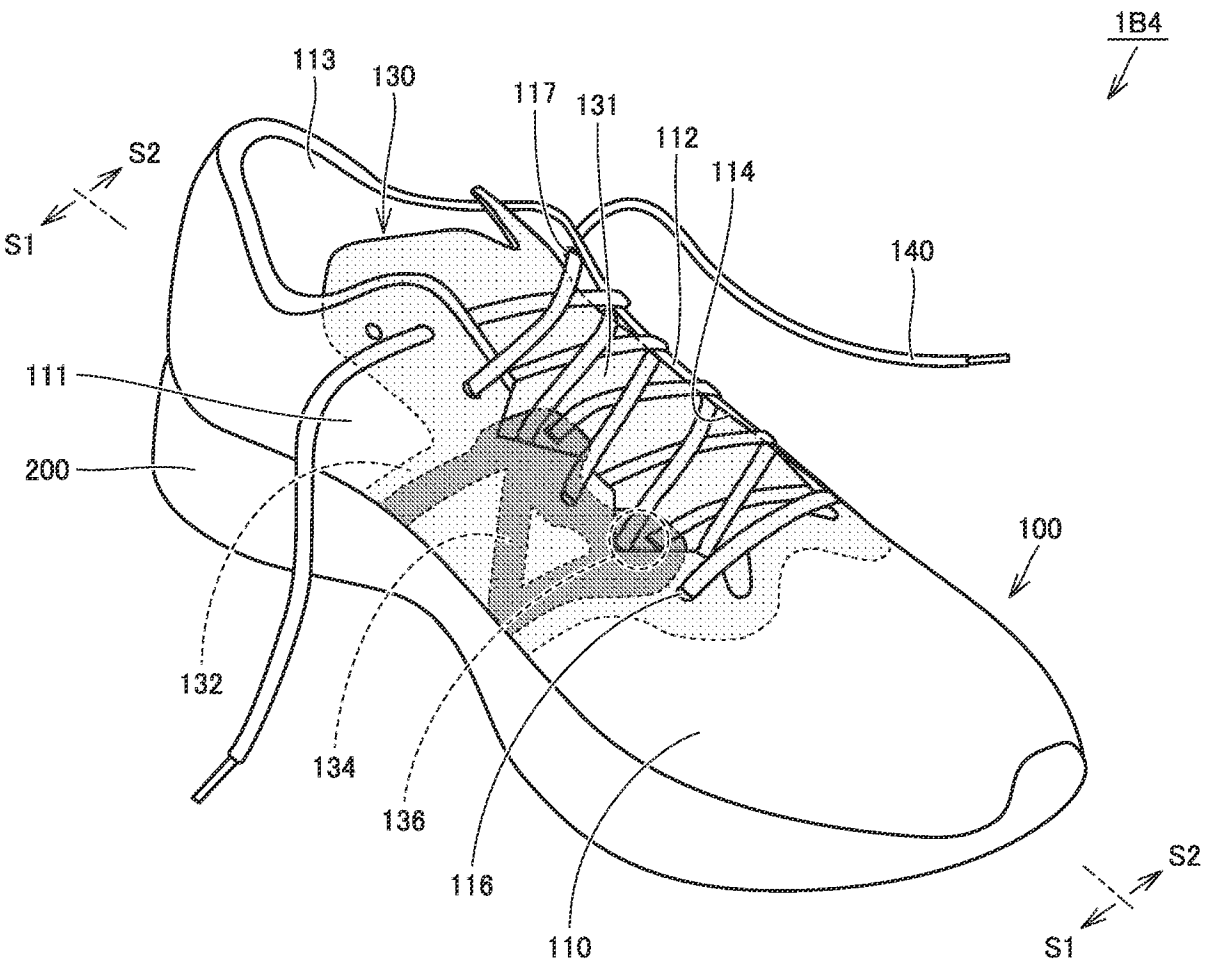
FIG. 11 is a perspective view of a shoe according to a fourth modification.

In the shoe 1B4 according to the fourth modification shown in FIG. 11, the medial foot-side reinforcing portion 134 has a substantially N-shape in a plan view. Such a configuration can also achieve substantially the same effect as that described in the aforementioned second embodiment. In the case where this configuration is adopted, the medial foot-side reinforcing portion 134 is smaller in size than that in the shoe 1B according to the second embodiment, by which the weight is reduced, and further, the effect of suppressing the wearer's foot from sliding sideways can be further enhanced.

Figure 12:
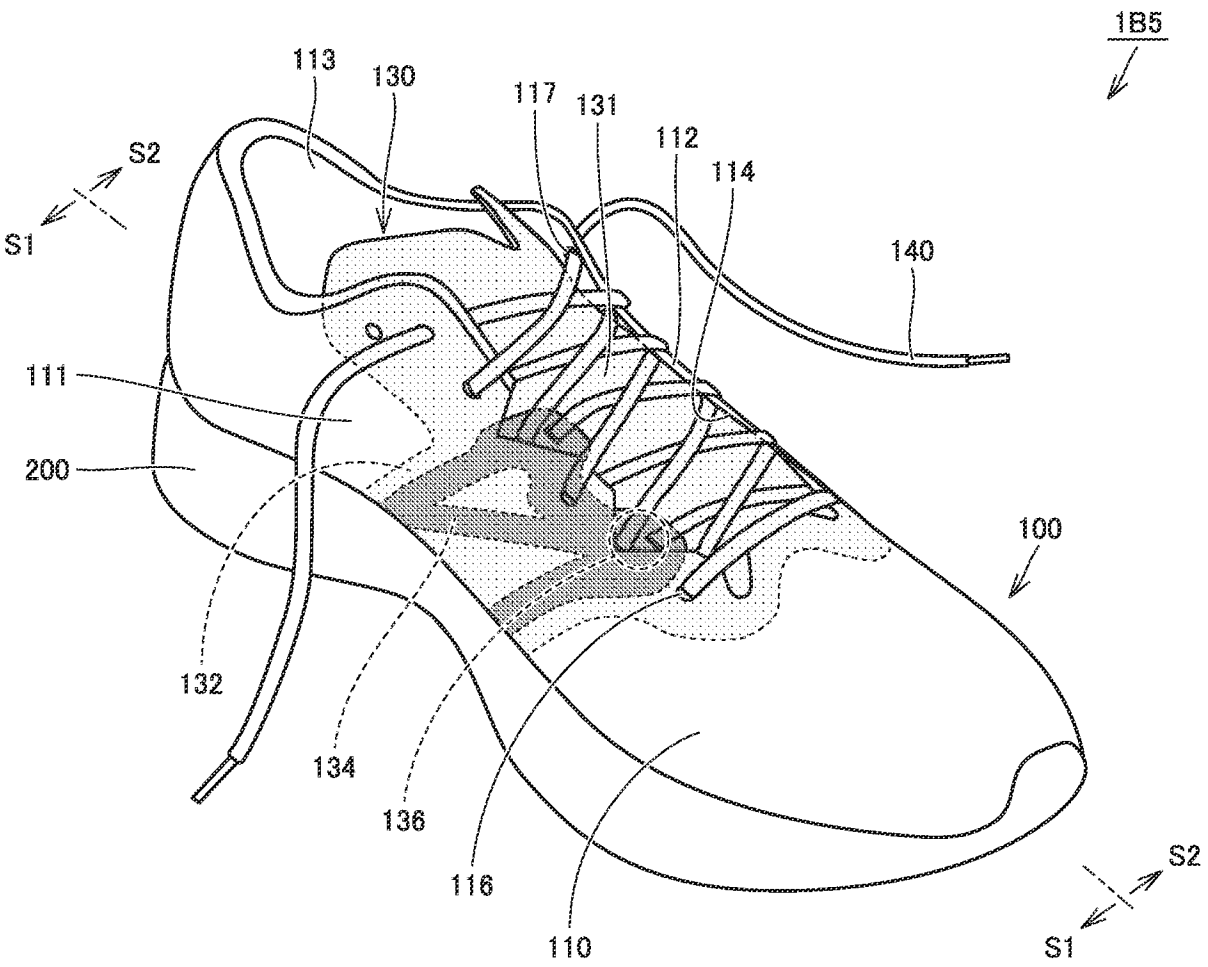
FIG. 12 is a perspective view of a shoe according to a fifth modification.

In the shoe 1B5 according to the fifth modification shown in FIG. 12, the medial foot-side reinforcing portion 134 has a substantially inverted N-shape in a plan view. Such a configuration can also achieve substantially the same effect as that described in the aforementioned second embodiment. In the case where this configuration is adopted, the medial foot-side reinforcing portion 134 is smaller in size than that in the shoe 1B according to the second embodiment, by which the weight is reduced, and further, the effect of suppressing the wearer's foot from sliding sideways can be further enhanced.

Figure 13:
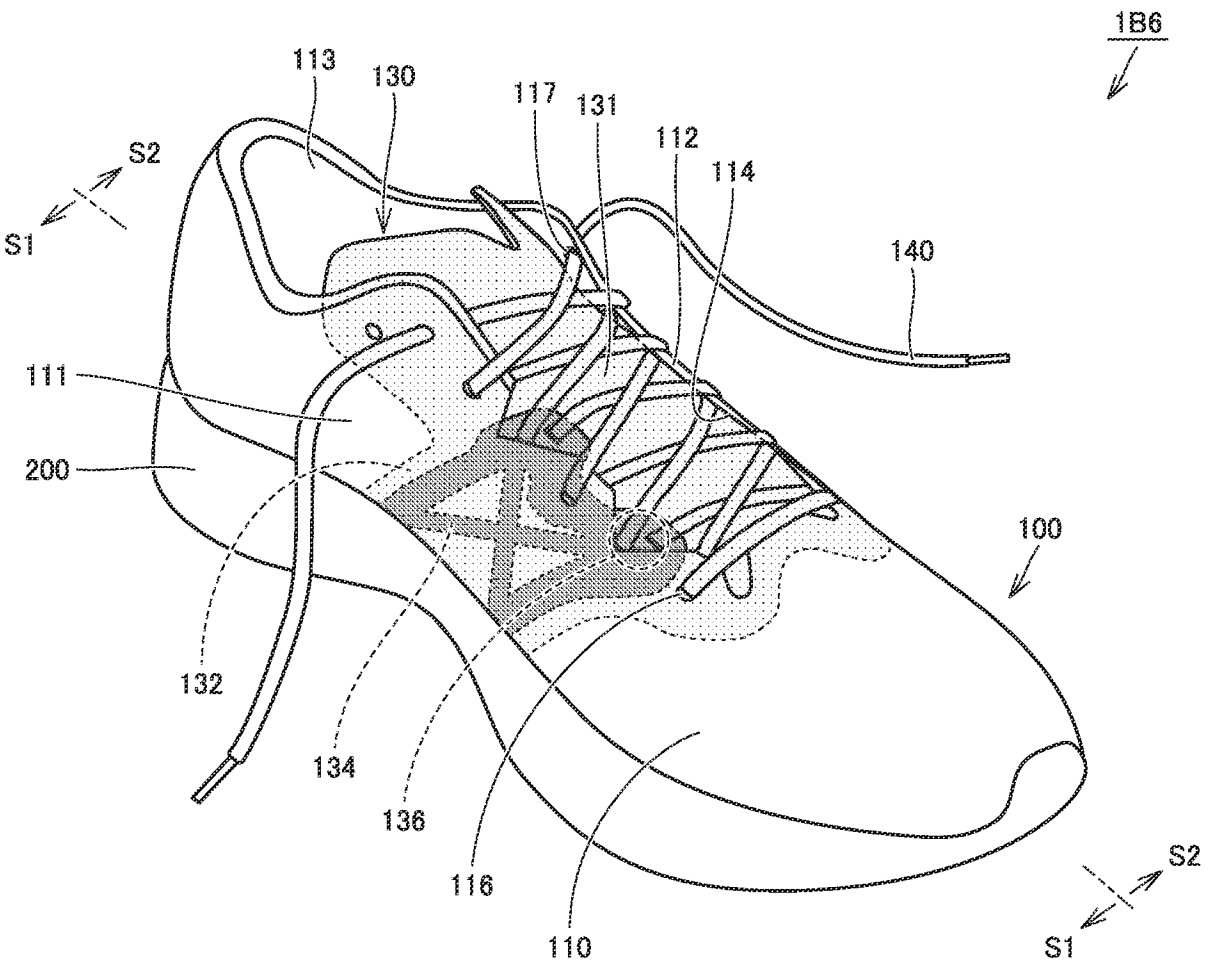
FIG. 13 is a perspective view of a shoe according to a sixth modification.

In the shoe 1B6 according to the sixth modification shown in FIG. 13, the medial foot-side reinforcing portion 134 has a shape obtained by combining a substantially inverted U-shaped portion in a plan view and a substantially X-shaped portion in a plan view. Such a configuration can also achieve substantially the same effect as that described in the aforementioned second embodiment. In the case where this configuration is adopted, the medial foot-side reinforcing portion 134 is smaller in size than that in the shoe 1B according to the second embodiment, by which the weight is reduced, and further, the effect of suppressing the wearer's foot from sliding sideways can be further enhanced.

Figure 14:
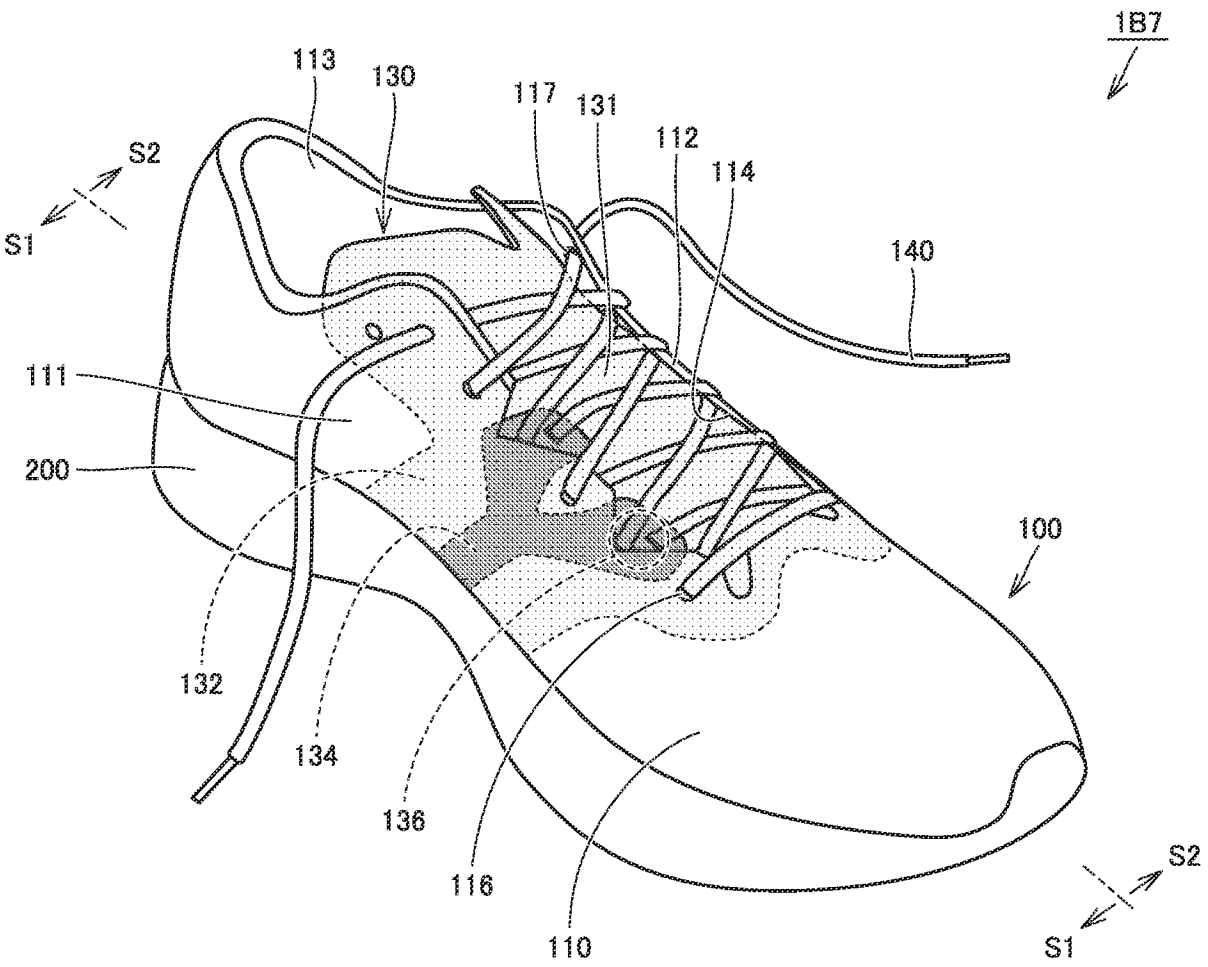
FIG. 14 is a perspective view of a shoe according to a seventh modification.

In the shoe 1B7 according to the seventh modification shown in FIG. 14, the medial foot-side reinforcing portion 134 has a substantially Y-shape in a plan view. Such a configuration can also achieve substantially the same effect as that described in the aforementioned second embodiment. In the case where this configuration is adopted, the medial foot-side reinforcing portion 134 is smaller in size than that in the shoe 1B according to the second embodiment, by which the weight is reduced, and further, the effect of pulling up the midfoot arch of the wearer's foot can be locally enhanced.

Figure 15:
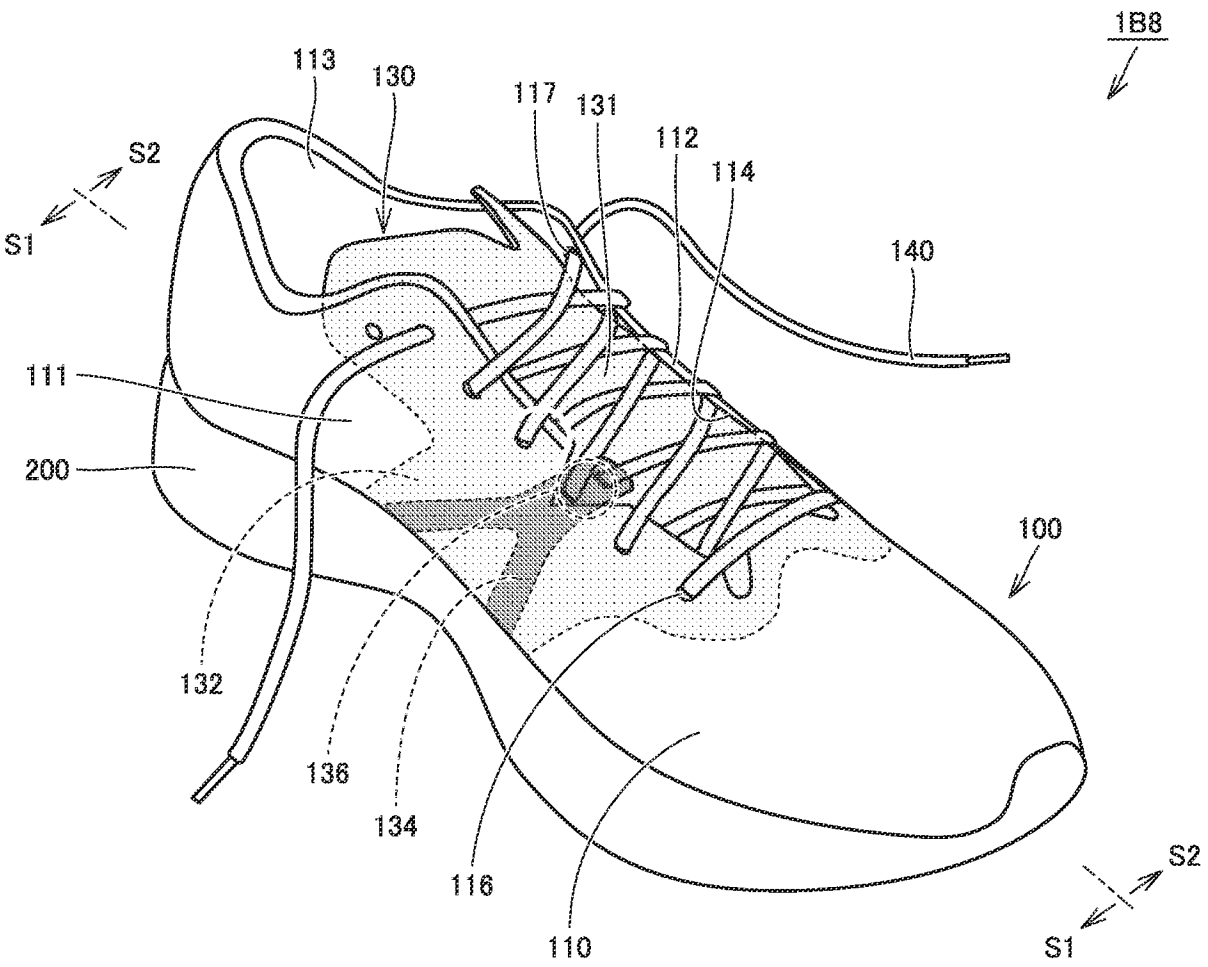
FIG. 15 is a perspective view of a shoe according to an eighth modification.

In the shoe 1B8 according to the eighth modification shown in FIG. 15, the medial foot-side reinforcing portion 134 has a substantially inverted Y-shape in a plan view. Thus, in the shoe 1B8 according to the eighth modification, only one shoelace passing-through portion 136 is provided in the shoe tongue 130, and the medial foot-side shoelace passing-through portion is configured by this one shoelace passing-through portion 136 provided in the shoe tongue 130 and six shoelace passing-through portions 116 provided in the upper body 110. Such a configuration can also achieve substantially the same effect as that described in the aforementioned second embodiment. In the case where this configuration is adopted, the medial foot-side reinforcing portion 134 is smaller in size than that in the shoe 1B according to the second embodiment, by which the weight is reduced, and further, the effect of pulling up the midfoot arch of the wearer's foot can be achieved in a wider range by a small number of shoelace passing-through portions 136 provided in the shoe tongue 130.

Third Embodiment

Figure 16:
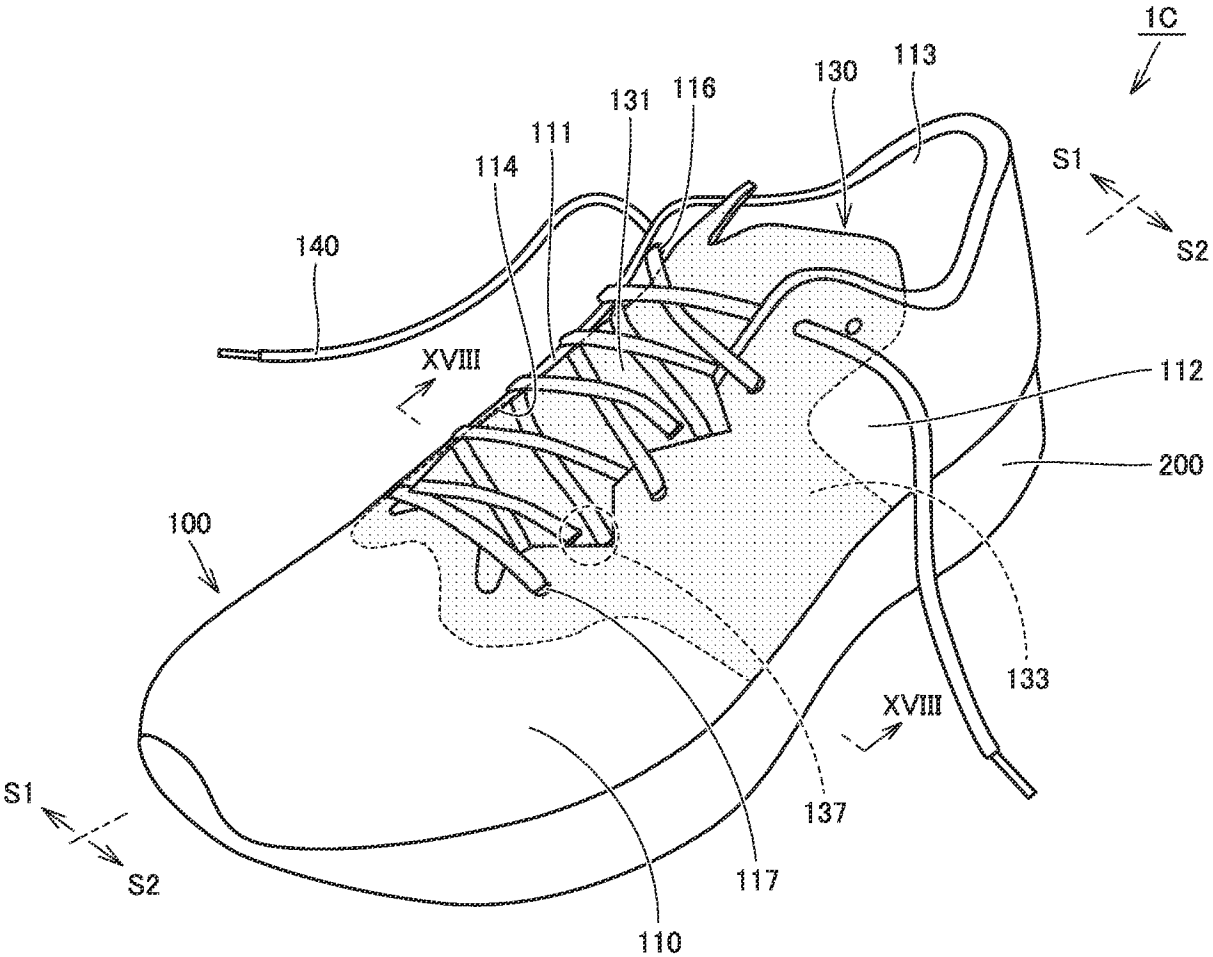
FIG. 16 is a perspective view of a shoe according to a third embodiment.
Figure 17:
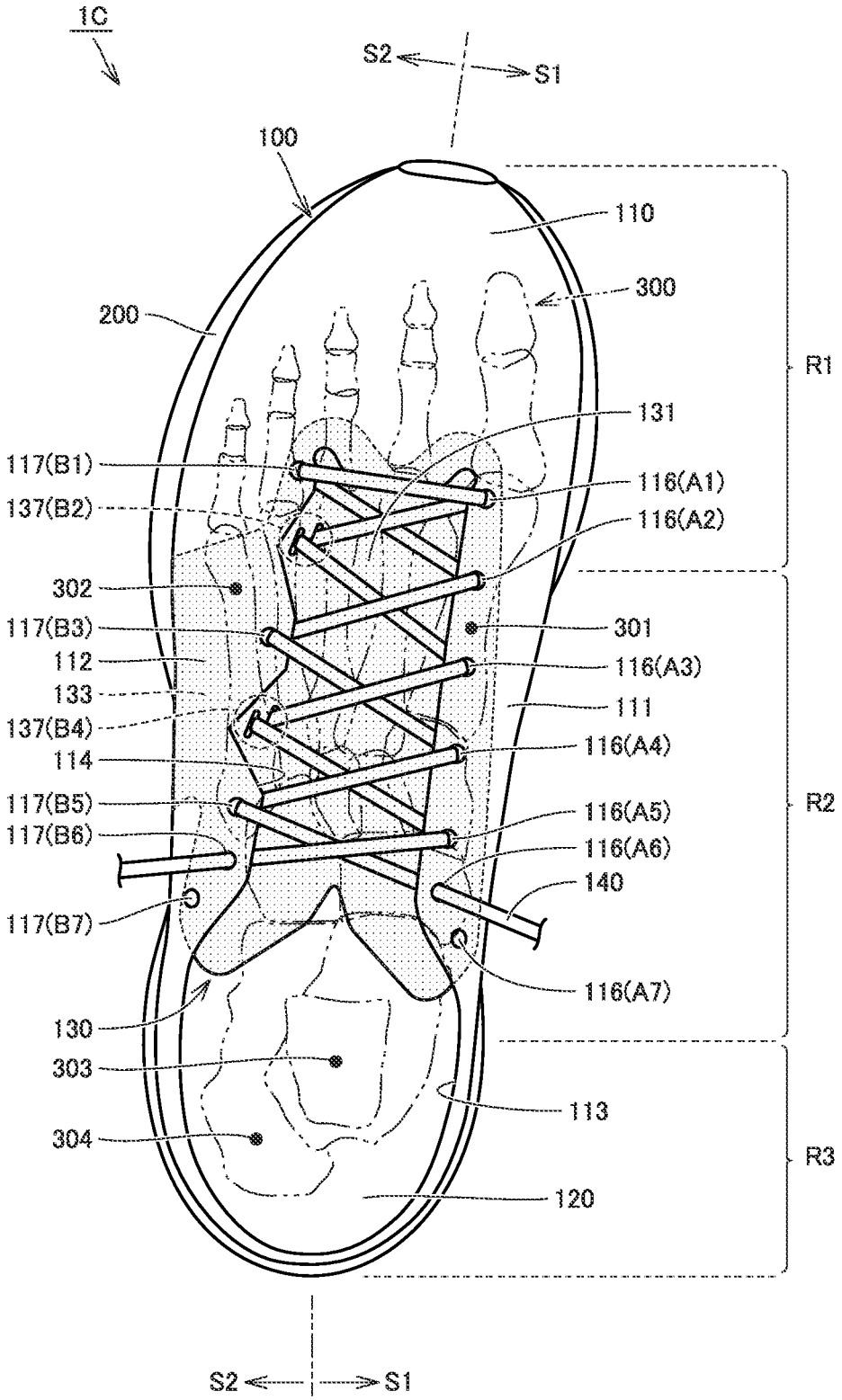
FIG. 17 is a plan view of the shoe shown in FIG. 16.
Figure 18:
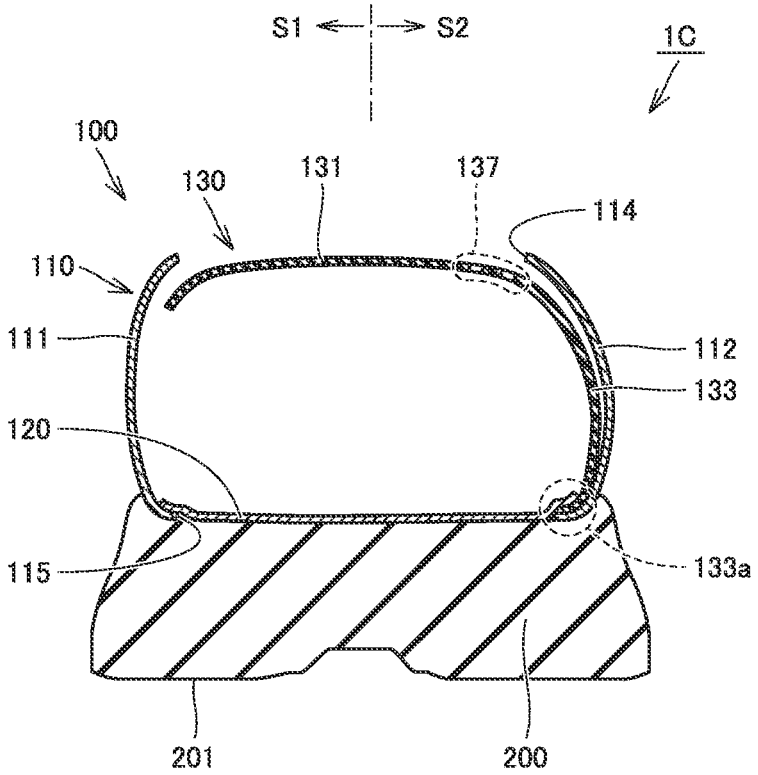
FIG. 18 is a cross-sectional view of the shoe shown in FIG. 16.
Figure 19:
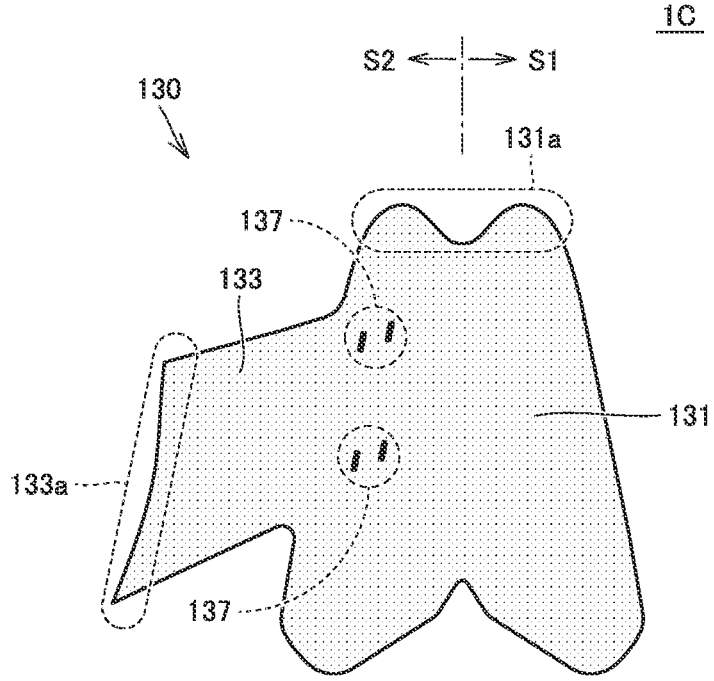
FIG. 19 is a plan view of a shoe tongue shown in FIG. 16 in a developed state.

FIG. 16 is a perspective view of a shoe according to the third embodiment. FIG. 17 is a plan view of the shoe shown in FIG. 16. FIG. 18 is a cross-sectional view showing the shoe and taken along a line XVIII-XVIII in FIG. 16. FIG. 19 is a plan view of a shoe tongue shown in FIG. 16 in a developed state. Referring to FIGS. 16 to 19, the following describes a shoe 1C according to the present embodiment. In FIG. 17, bones 300 of a foot are superimposed on the shoe 1C so as to allow clear understanding of the positional relation between the shoe and the bones of the wearer's foot.

As shown in FIGS. 16 to 19, the shoe 1C is different from the shoe 1A according to the first embodiment only in the configurations of the upper body 110 and the shoe tongue 130. Specifically, in the shoe 1C, the shoe tongue 130 does not include the medial foot-side extending portion 132 (see FIGS. 1 to 4) but instead includes the lateral foot-side extending portion 133, and accordingly, the configuration of the peripheral edge of the central opening 114 of the upper body 110 is also different.

In the shoe 1C according to the present embodiment, the upper body 110 includes a lateral foot-side wall portion 112 as the first wall portion and a medial foot-side wall portion 111 as the second wall portion. A top opening 113 and a central opening 114 are provided in an upper portion of the upper body 110. The top opening 113 and the central opening 114 each are defined by a top end portion of the medial foot-side wall portion 111 and a top end portion of the lateral foot-side wall portion 112.

On the other hand, in the shoe 1C according to the present embodiment, the shoe tongue 130 includes a cover portion 131 and a lateral foot-side extending portion 133 as the first extending portion. The cover portion 131 and the lateral foot-side extending portion 133 are configured by a prescribed portion of the shoe tongue 130 formed of a single member.

The lateral foot-side extending portion 133 is formed of a strip-shaped portion extending from the peripheral edge of the cover portion 131 toward the lateral foot side of the shoe 1C (i.e., toward the S2 side shown in the figure). The medial foot-side extending portion 133 extends from the peripheral edge of the cover portion 131 in this way, and thereby, is located to extend along the inner surface of the lateral foot-side wall portion 112 of the upper body 110 toward the bottom end portion of the lateral foot-side wall portion 112.

The lateral foot-side extending portion 133 has a lower end including a fixing portion 133*a* (see FIGS. 18 and 19) that is joined to a bottom end portion of the lateral foot-side wall portion 112 of the upper body 110, for example, by sewing, welding, bonding, or a combination thereof. Note that the fixing portion 133*a* of the lateral foot-side extending portion 133 may be fixed to the upper body 110 as well as the insole 120 fixed to the upper body 110, may be fixed only to the insole 120, or may be fixed only to the upper body 110 separately from the insole 120. Further, the fixing portion 133*a* of the lateral foot-side extending portion 133 may be fixed to the sole 200.

In this case, the above-mentioned single member forming the shoe tongue 130 is made of a material higher in stretchability than the material forming the upper body 110. Thus, in the portion on the lateral foot side (i.e., on the S2 side shown in the figure) of the shoe 1C, the lateral foot-side wall portion 112 of the upper body 110 and the lateral foot-side extending portion 133 of the shoe tongue 130 are arranged to overlap with each other such that the lateral foot-side wall portion 112 made of a relatively low stretchable and relatively highly rigid material is located on the outer side while the lateral foot-side extending portion 133 made of a relatively highly stretchable and relatively low rigid material is located on the inner side.

Further, in the cover portion 131 of the shoe tongue 130, a portion closer to the lateral foot-side extending portion 133 is provided with a plurality of shoelace passing-through portions 137 each as a shoe tongue-side first shoelace passing-through portion. Each of these shoelace passing-through portions 137, through which the shoelace 140 is inserted, is formed of a pair of through holes provided in the cover portion 131.

In this case, each of the plurality of shoelace passing-through portions 137 is formed of a pair of through holes for the purpose of allowing the shoelace 140 inserted into one through hole from the upper surface side of the shoe tongue 130 to be folded back on the lower surface side of the shoe tongue 130 and then inserted into the other through hole, to thereby allow the shoelace 140 to be pulled out again to the upper surface side of the shoe tongue 130.

It is preferable that one of the pair of through holes is located to be more inward in the left-right direction of the shoe 1C and more forward in the front-rear direction of the shoe 1C than the other of the pair of through holes. By the configuration as described above, the folded shoelace 140 does not overlap with itself in the portion where the shoelace 140 is folded back, or even if the folded shoelace 140 overlaps with itself, the overlapping area can be reduced.

Thus, the configuration as described above makes it possible to reduce the feeling of contact that the wearer's foot receives from the folded-back portion of the shoelace 140, which enables a more excellent fit to the wearer's foot. Note that it is particularly effective to employ the above-described configuration since each of the shoelace passing-through portions 137 provided in the shoe tongue 130 is provided at a position closer to the wearer's foot than each of the shoelace passing-through portions 117 (described later) provided in the upper body 110.

The plurality of shoelace passing-through portions 137 are disposed at prescribed positions in the cover portion 131 so as to be located along a top end portion of the lateral foot-side wall portion 112 of the upper body 110 as described later. In the present embodiment, a total of two shoelace passing-through portions 137 are provided as shown in the figure.

Further, as shown in FIGS. 16 and 17, in the shoe 1C according to the present embodiment, a plurality of shoelace passing-through portions 117 as upper-side first shoelace passing-through portions are provided in the top end portion of the lateral foot-side wall portion 112 of the upper body 110. Each of these shoelace passing-through portions 117, through which the shoelace 140 is inserted, is formed of a single through hole provided in the upper body 110.

The plurality of shoelace passing-through portions 117 are arranged side by side in the front-rear direction along the top end portion of the lateral foot-side wall portion 112 of the upper body 110. In the present embodiment, as shown in the figures, a total of five shoelace passing-through portions 117 are provided, including what is called an extra hole.

On the other hand, in the shoe 1C according to the present embodiment, a plurality of shoelace passing-through portions 116 are provided in the top end portion of the medial foot-side wall portion 111 of the upper body 110. Each of these shoelace passing-through portions 116, through which the shoelace 140 is inserted, is formed of a single through hole provided in the upper body 110.

The plurality of shoelace passing-through portions 116 are arranged side by side in the front-rear direction along the top end portion of the medial foot-side wall portion 111 of the upper body 110. In the present embodiment, as shown in the figures, a total of seven shoelace passing-through portions 116 are provided, including what is called an extra hole.

By the configuration as described above, in the shoe 1C according to the present embodiment, the lateral foot-side portion of the upper 100 is provided with a total of seven shoelace passing-through portions located substantially linearly side by side in the front-rear direction while the medial foot-side portion of the upper 100 is provided with a total of seven shoelace passing-through portions located substantially linearly side by side in the front-rear direction.

Then, referring to FIG. 17, reference numerals A1 to A7 are assigned in order from the front side to the rear side in the front-rear direction to the medial foot-side shoelace passing-through portions, specifically, a total of seven shoelace passing-through portions arranged in the medial foot-side portion of the upper body 110. In this case, in the shoe 1C according to the present embodiment, the medial foot-side shoelace passing-through portions A1 to A7 are configured of the shoelace passing-through portions 116 provided in the top end portion of the medial foot-side wall portion 111 of the upper body 110.

On the other hand, referring to FIG. 17, reference numerals B1 to B7 are assigned in order from the front side to the rear side in the front-rear direction to the lateral foot-side shoelace passing-through portions, specifically, a total of seven shoelace passing-through portions arranged in the lateral foot-side portion of the upper body 110. In this case, in the shoe 1C according to the present embodiment, the lateral foot-side shoelace passing-through portions B1, B3, and B5 to B7 are configured of the shoelace passing-through portions 117 provided in the top end portion of the lateral foot-side wall portion 112 of the upper body 110, and the lateral foot-side shoelace passing-through portions B2 and B4 are configured of the shoelace passing-through portions 137 provided in the cover portion 131 of the shoe tongue 130.

Further, in the shoe 1C according to the present embodiment, a notch having a V-shape in a plan view is provided in the top end portion of the lateral foot-side wall portion 112 of the upper body 110 in a portion corresponding to each shoelace passing-through portion 137 provided in the shoe tongue 130, so that the shoelace passing-through portion 137 is disposed inside the notch. By the configuration as described above, a total of seven lateral foot-side shoelace passing-through portions B1 to B7 are arranged substantially linearly side by side in the front-rear direction.

The shoelace 140 is inserted in prescribed order through the medial foot-side shoelace passing-through portions A1 to A7 and the lateral foot-side shoelace passing-through portions B1 to B7. However, in the state shown in FIG. 17, an extra hole A7 among the medial foot-side shoelace passing-through portions A1 to A7 and an extra hole B7 among the lateral foot-side shoelace passing-through portions B1 to B7 are not used.

In this case, starting from one end portion pulled out to the medial foot side to the other end portion pulled out to the lateral foot side, the shoelace 140 having this pair of end portions extending in the length direction is passed through the shoelace passing-through portions in order of the medial foot-side shoelace passing-through portion A6, the lateral foot-side shoelace passing-through portion B5, the medial foot-side shoelace passing-through portion A4, the lateral foot-side shoelace passing-through portion B3, the medial foot-side shoelace passing-through portion A2, the lateral foot-side shoelace passing-through portion B1, the medial foot-side shoelace passing-through portion A1, the lateral foot-side shoelace passing-through portion B2, the medial foot-side shoelace passing-through portion A3, the lateral foot-side shoelace passing-through portion B4, the medial foot-side shoelace passing-through portion A5, and the lateral foot-side shoelace passing-through portion B6.

Thus, when attention is paid to the medial foot-side shoelace passing-through portions A1 to A6, from the lateral foot side (i.e., the S2 side shown in the figure), the shoelace 140 is inserted and folded back through each of the plurality of shoelace passing-through portions 116 (i.e., each of the medial foot-side shoelace passing-through portions A1 to A6) provided in the upper body 110.

On the other hand, when attention is paid to the lateral foot-side shoelace passing-through portions B1 to B6, from the medial foot side (i.e., the S1 side shown in the figure), the shoelace 140 is inserted and folded back through each of the plurality of shoelace passing-through portions 117 (i.e., each of the lateral foot-side shoelace passing-through portions B1, B3, B5, and B6) provided in the upper body 110. Also, from the medial foot side (i.e., the S1 side shown in the figure), the shoelace 140 is inserted and folded back through each of the plurality of shoelace passing-through portions 137 (i.e., each of the lateral foot-side shoelace passing-through portions B2 and B4) provided in the shoe tongue 130.

In this case, as described above, the lower end of the lateral foot-side extending portion 133 of the shoe tongue 130 is fixed to the bottom end portion of the lateral foot-side wall portion 112 of the upper body 110. Thus, in the portion including each shoelace passing-through portion 137 through which the shoelace 140 is inserted, the shoe tongue 130 receives the tightening force of the shoelace 140 and thereby is pulled toward the medial foot side (i.e., toward the S1 side shown in the figure), so that the lateral foot-side portion of the shoe tongue 130 is brought into close contact with the wearer's foot.

As described above, the shoe tongue 130 is made of a material higher in stretchability than the material of the upper body 110. Thus, at this time, the lateral foot-side portion of the shoe tongue 130 comes into close contact with the wearer's foot while being stretched in the circumferential direction of the wearer's foot. Accordingly, during a low-intensity exercise, the feeling of restraint by the shoe 1C is reduced and the shoe 1C is appropriately fitted to the wearer's foot, with the result that what is called a stationary fit is improved.

On the other hand, in the portion including each shoelace passing-through portion 117 through which the shoelace 140 is inserted, the lateral foot-side wall portion 112 of the upper body 110 receives the tightening force of the shoelace 140 and thereby is pulled toward the medial foot side (i.e., toward the S1 side shown in the figure), so that the lateral foot-side wall portion 112 is brought into close contact with the wearer's foot. Further, in the portion including each shoelace passing-through portion 116 through which the shoelace 140 is inserted, the medial foot-side wall portion 111 of the upper body 110 receives the tightening force of the shoelace 140 and thereby is pulled toward the lateral foot side (i.e., toward the S2 side shown in the figure), so that the medial foot-side wall portion 111 is brought into close contact with the wearer's foot.

As described above, the upper body 110 is made of a material higher in rigidity than the material of the shoe tongue 130. Thus, at this time, the medial foot-side wall portion 111 and the lateral foot-side wall portion 112 are hardly stretched but tightened so as to collapse inward. Accordingly, during a high-intensity exercise, the shoe 1C follows the movement of the foot to thereby keep the state in which the wearer's foot is appropriately held by the shoe 1C, with the result that what is called a dynamic fit is improved.

Therefore, by the shoe 1C according to the present embodiment as described above, excellent functions are exerted both in the stationary fit that is important during a low-intensity exercise and the dynamic fit that is important during a high-intensity exercise. Thereby, a shoe balanced between the stationary fit and the dynamic fit can be obtained.

Further, as described above, the shoe 1C according to the present embodiment adopts the configuration in which, in the portion on the lateral foot side (i.e., the S2 side shown in the figure), the lateral foot-side extending portion 133 made of a relatively low rigid material in the shoe tongue 130 is disposed on the inner side of the lateral foot-side wall portion 112 made of a relatively highly rigid material in the upper body 110. Thus, this lateral foot-side extending portion 133 made of a low rigid material serves as a shock absorbing cushion to prevent the lateral foot-side wall portion 112 made of a highly rigid material from directly contacting the wearer's foot. This also allows an improved fit to the wearer's foot.

Further, in the shoe 1C according to the present embodiment, the lateral foot-side extending portion 133 of the shoe tongue 130 extends out from the cover portion 131 in the midfoot portion R2, and the lower end of the lateral foot-side extending portion 133 is fixed to the bottom end portion of the lateral foot-side wall portion 112 of the upper body 110 in the midfoot portion R2. The configuration as described above may also achieve an effect of pulling up a midfoot arch of the wearer's foot (i.e., the effect of suppressing occurrence of a phenomenon in which a long-term exercise or the like causes lowering of the midfoot arch).

In this case, the lateral foot-side extending portion 133 of the shoe tongue 130 is preferably provided so as to cover a fifth metatarsal bone 302 of the wearer's foot. For example, by providing the lateral foot-side extending portion 133 so as to cover at least the front end portion of the fifth metatarsal bone 302 (i.e., by providing the lateral foot-side extending portion 133 so as to include a position ranging from the front end of the shoe to 30% to 40% of the dimension of the shoe in the front-rear direction with respect to the front end of the shoe), the stationary fit on the portion close to the forefoot portion R1 in the entire shoe can be improved. Further, by providing the lateral foot-side extending portion 133 so as to cover at least the central portion of the fifth metatarsal bone 302 (i.e., by providing the lateral foot-side extending portion 133 so as to include a position ranging from the front end of the shoe to 35% to 45% of the dimension of the shoe in the front-rear direction with respect to the front end of the shoe), the stationary fit on the midfoot portion R2 in the entire shoe can be improved. Further, by providing the lateral foot-side extending portion 133 so as to cover at least the rear end portion of the fifth metatarsal bone 302 (i.e., by providing the lateral foot-side extending portion 133 so as to include a position ranging from the front end of the shoe to 45% to 55% of the dimension of the shoe in the front-rear direction with respect to the front end of the shoe), the stationary fit on the portion close to the rearfoot portion R3 in the entire shoe can be improved.

The aforementioned present embodiment has exemplified the configuration in which the shoe tongue 130 is formed of a single member, and thus, the entire shoe tongue 130 including not only the lateral foot-side extending portion 133 but also the cover portion 131 is formed of a material higher in stretchability than the material forming the lateral foot-side wall portion 112 of the upper body 110. However, the shoe tongue 130 may be formed by a plurality of members integrated with each other. In that case, the above-described various effects can be achieved as long as at least the lateral foot-side extending portion 133 is made of a material higher in stretchability than the material forming the lateral foot-side wall portion 112.

Further, the aforementioned present embodiment has exemplified the configuration in which, among a total of seven lateral foot-side shoelace passing-through portions, two of them are formed of the shoelace passing-through portions 137 provided in the shoe tongue 130. However, the total number of the lateral foot-side shoelace passing-through portions is not particularly limited. Further, there is no particular limitation as to how many of the lateral foot-side shoelace passing-through portions is/are to be formed of the shoelace passing-through portion 137 provided in the shoe tongue 130. Further, there is no particular limitation as to which one of the lateral foot-side shoelace passing-through portions is to be formed of the shoelace passing-through portion 137 provided in the shoe tongue 130.

In this case, when two or more of the lateral foot-side shoelace passing-through portions are formed of the shoelace passing-through portions 137 provided in the shoe tongue 130, it is preferable that the shoelace passing-through portions 117 provided in the upper body 110 and the shoelace passing-through portions 137 provided in the shoe tongue 130 are alternately arranged in the front-rear direction of the shoe. By the configuration as described above, the upper body 110 and the shoe tongue 130 can be equally tightened by the shoelace 140, so that a stationary fit and a dynamic fit can be further enhanced. Also in that case, the lateral foot-side shoelace passing-through portion located on the foremost side is preferably one of the shoelace passing-through portions 117 provided in the upper body 110.

Further, the aforementioned present embodiment has exemplified the configuration in which the lateral foot-side shoelace passing-through portions including the shoelace passing-through portion 117 provided in the upper body 110 and the shoelace passing-through portion 137 provided in the shoe tongue 130 are positioned substantially linearly side by side in the front-rear direction, but the present invention is not necessarily configured in this way. For example, when the shoelace 140 is formed of a member lower in stretchability than the member of the shoe tongue 130, each shoelace passing-through portion 137 provided in the shoe tongue 130 is disposed closer to the fixing portion 133*a* than each shoelace passing-through portion 117 provided in the upper body 110 (i.e., at a lower position closer to the lateral foot side), and thereby, the above-mentioned effect of pulling up the midfoot arch of the wearer's foot can be enhanced. On the other hand, when the shoelace 140 is formed of a member higher in stretchability than the member of the shoe tongue 130, each shoelace passing-through portion 137 provided in the shoe tongue 130 is disposed on the side opposite to the fixing portion 133*a* with respect to each shoelace passing-through portion 117 provided in the upper body 110 (i.e., at a higher position closer to the medial foot side), and thereby, the above-mentioned effect of pulling up the midfoot arch of the wearer's foot can be enhanced.

Further, the aforementioned present embodiment has exemplified the configuration in which a notch is provided in the lateral foot-side wall portion 112 of the upper body 110 at a position corresponding to the portion where the shoelace passing-through portion 137 provided in the shoe tongue 130 is located, and thereby, this shoelace passing-through portion 137 is exposed to the outside. The present invention is however not necessarily configured in this way. In other words, it is not necessarily essential to provide a notch in the lateral foot-side wall portion 112 of the upper body 110, and also not necessarily essential to expose the shoelace passing-through portion 137 provided in the shoe tongue 130 to the outside.

In the case where the shoelace passing-through portion 137 provided in the shoe tongue 130 is disposed closer to the fixing portion 133*a* (i.e., at a lower position closer to the lateral foot side), the shoelace passing-through portion 137 may be provided not in the cover portion 131 but in the lateral foot-side extending portion 133 in the shoe tongue 130.

Fourth Embodiment

Figure 20:
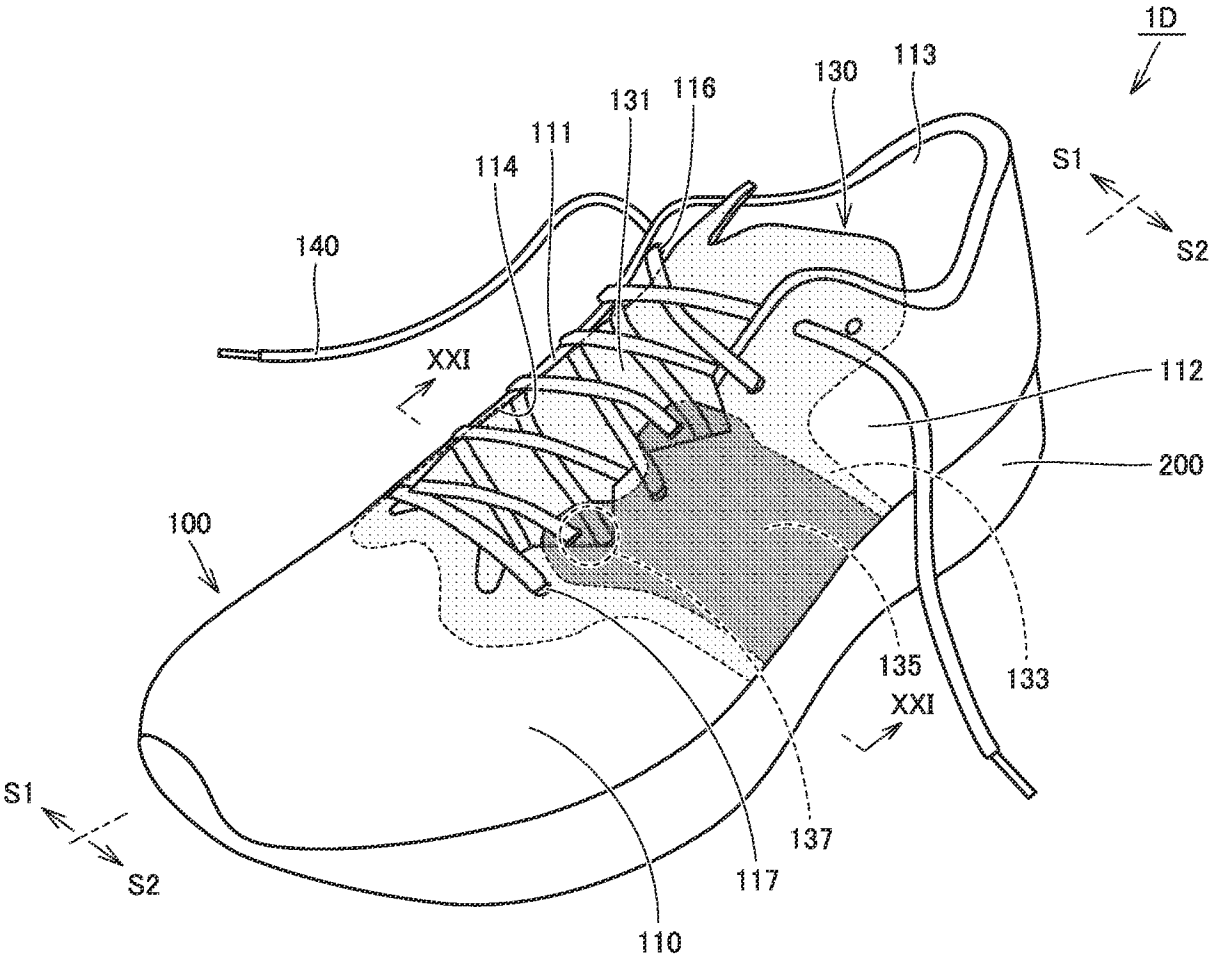
FIG. 20 is a perspective view of a shoe according to a fourth embodiment.
Figure 21:
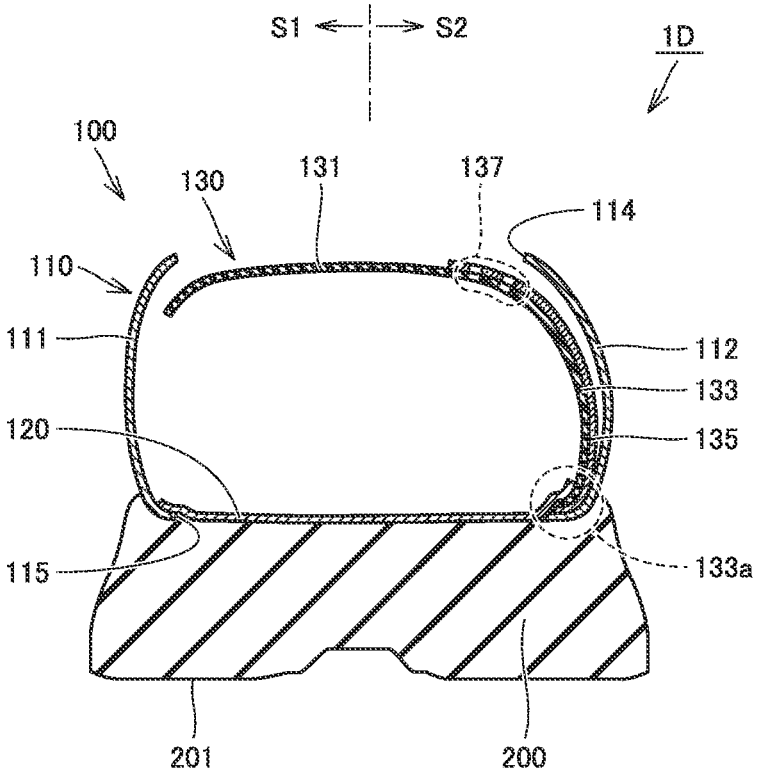
FIG. 21 is a cross-sectional view of the shoe shown in FIG. 20.
Figure 22:
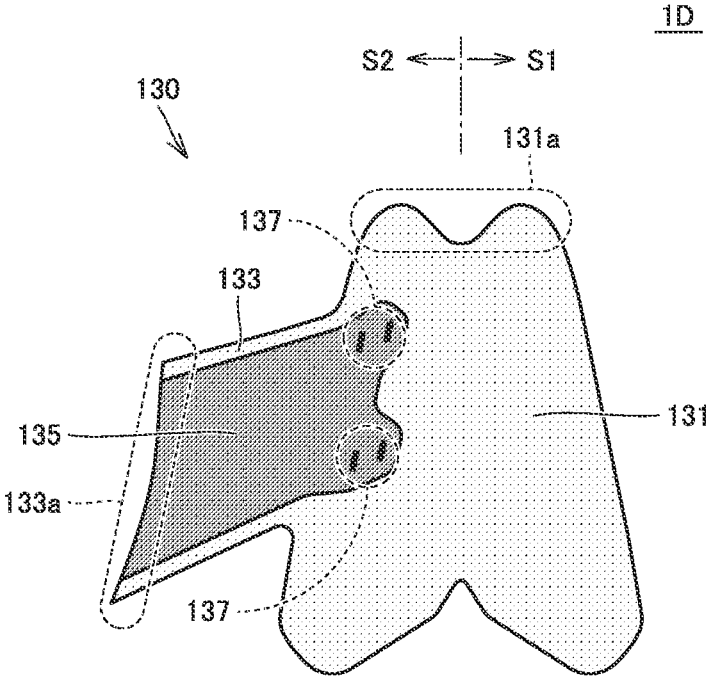
FIG. 22 is a plan view of a shoe tongue shown in FIG. 20 in a developed state.

FIG. 20 is a perspective view of a shoe according to the fourth embodiment. FIG. 21 is a cross-sectional view showing the shoe and taken along a line XXI-XXI in FIG. 20. FIG. 22 is a plan view of a shoe tongue shown in FIG. 20 in a developed state. Referring to FIGS. 20 to 22, the following describes a shoe 1D according to the present embodiment.

As shown in FIGS. 20 to 22, the shoe 1D is different from the shoe 1C according to the third embodiment only in the configuration of the shoe tongue 130. Specifically, in the shoe 1D, the shoe tongue 130 includes a lateral foot-side reinforcing portion 135 as the first reinforcing portion.

The lateral foot-side reinforcing portion 135 serves to mainly reinforce the lateral foot-side extending portion 133 of the shoe tongue 130, and is provided so as to cover a prescribed portion on the upper surface of the lateral foot-side extending portion 133. In the present embodiment, the lateral foot-side reinforcing portion 135 is formed in a substantially rectangular shape in a plan view, and covers substantially the entire upper surface of the lateral foot-side extending portion 133.

The lateral foot-side reinforcing portion 135 is made of a material higher in stretchability than the material forming the upper body 110 and higher in rigidity than the material forming the lateral foot-side extending portion 133 of the shoe tongue 130. Thus, in the portion on the lateral foot side (i.e., the S2 side shown in the figure) of the shoe 1D including the lateral foot-side reinforcing portion 135, specifically, the lateral foot-side wall portion 112 of the upper body 110, the lateral foot-side extending portion 133 of the shoe tongue 130, and the lateral foot-side reinforcing portion 135 are arranged to overlap with each other such that the lateral foot-side wall portion 112 made of a relatively low stretchable and relatively highly rigid material is located on the outermost side, the lateral foot-side extending portion 133 made of a relatively highly stretchable and relatively low rigid material is located on the innermost side, and the lateral foot-side reinforcing portion 135 made of a relatively moderately stretchable and rigid material is located between the lateral foot-side wall portion 112 and the lateral foot-side extending portion 133.

The lateral foot-side reinforcing portion 135 can be formed, for example, of a TPU film, a mesh member, a rubber member, or the like, and is joined to the upper surface of the shoe tongue 130, for example, by bonding, sewing, welding, or a combination thereof. In other words, the lateral foot-side reinforcing portion 135 is formed of a layered member so as to cover the surface of a prescribed portion of the shoe tongue 130.

In this case, the thickness of the layered lateral foot-side reinforcing portion 135 is not particularly limited, but is, for example, 0.1 mm or more and 1.2 mm or less, and more suitably 0.3 mm or more and 0.7 mm or less. Further, the width of the lateral foot-side reinforcing portion 135 in a plan view (i.e., the outer dimension in the direction orthogonal to the circumferential direction of the wearer's foot) is not particularly limited, but is preferably 10 mm or more.

In the configuration as described above, the durability of the shoe tongue 130 can be improved as compared with the case where the shoe tongue 130 is made only of a highly stretchable material. On the other hand, since the lateral foot-side reinforcing portion 135 is made of a material higher in stretchability than the material of the lateral foot-side wall portion 112 in the upper body 110, the stretchability of the entire shoe tongue 130 does not extremely decrease, and the lateral foot-side extending portion 133 is appropriately stretched when the shoelace 140 is tightened.

In particular, when the lateral foot-side reinforcing portion 135 is formed of a TPU film, a mesh member, a rubber member, or the like as described above, the lateral foot-side reinforcing portion 135 has a property of being less likely to deform upon receiving instantaneous force, but being more likely to deform upon receiving continuous force, which is therefore extremely suitable for improving a stationary fit.

Therefore, the shoe 1D according to the present embodiment not only can achieve the balance between the stationary fit and the dynamic fit as in the third embodiment, but also can achieve further excellent durability.

In the shoe 1D according to the present embodiment, the lateral foot-side reinforcing portion 135 covers substantially the entire upper surface of the lateral foot-side extending portion 133 as described above, so that a particularly high stationary fit can be achieved.

In this case, the lateral foot-side reinforcing portion 135 preferably extends in the direction in which the lateral foot-side extending portion 133 extends (i.e., in the direction corresponding to the circumferential direction of the wearer's foot). This is because, when the shoelace 140 is tightened, or when the wearer's foot moves inside the shoe, the direction in which the lateral foot-side extending portion 133 is mainly stretched corresponds to the direction in which the lateral foot-side extending portion 133 extends. Thus, the lateral foot-side reinforcing portion 135 extending in this direction can effectively reinforce the lateral foot-side extending portion 133.

In addition, by the configuration as described above, during tightening of the shoelace 140, the tightening force of the shoelace 140 is appropriately transmitted to the lateral foot-side extending portion 133 (i.e., the lateral foot-side extending portion 133 is not stretched more than necessary), so that the effect of pulling up the midfoot arch of the wearer's foot can also be enhanced. Further, in addition to the lateral foot-side wall portion 112, the lateral foot-side reinforcing portion 135 having relatively high rigidity is located in the portion on the lateral foot side (i.e., on the S2 side shown in the figure) of the shoe 1D, to thereby also improve a dynamic fit, which makes it also possible to suppress the wearer's foot from sliding sideways (i.e., suppress movement of the wearer's foot in the left-right direction of the shoe 1D).

Further, the lower end of the lateral foot-side reinforcing portion 135 preferably reaches the fixing portion 133*a* of the lateral foot-side extending portion 133 as shown in the figure. In the configuration as described above, the fixing portion 133*a* of the shoe tongue 130 including the lower end of the lateral foot-side reinforcing portion 135 is fixed to the upper body 110, which makes it possible to enhance the fixing strength in the fixing portion 133*a*.

Further, the lateral foot-side reinforcing portion 135 may be provided so as to reach the cover portion 131. In this case, the lateral foot-side reinforcing portion 135 is preferably provided so as to cover the portion of the cover portion 131 where the shoelace passing-through portion 137 is provided as shown in the figure. By the configuration as described above, the shoelace passing-through portion 137 receiving the force applied by the shoelace 140 can also be simultaneously reinforced, so that the durability can be further improved.

In the shoe 1D according to the present embodiment, the lateral foot-side reinforcing portion 135 is provided so as to cover the upper surface of the lateral foot-side extending portion 133 and the upper surface of the cover portion 131, but may be provided so as to cover the lower surface of the lateral foot-side extending portion 133 and the lower surface of the cover portion 131, or may be provided so as to cover the upper and lower surfaces of the lateral foot-side extending portion 133 and the upper and lower surfaces of the cover portion 131.

Fifth Embodiment

Figure 23:
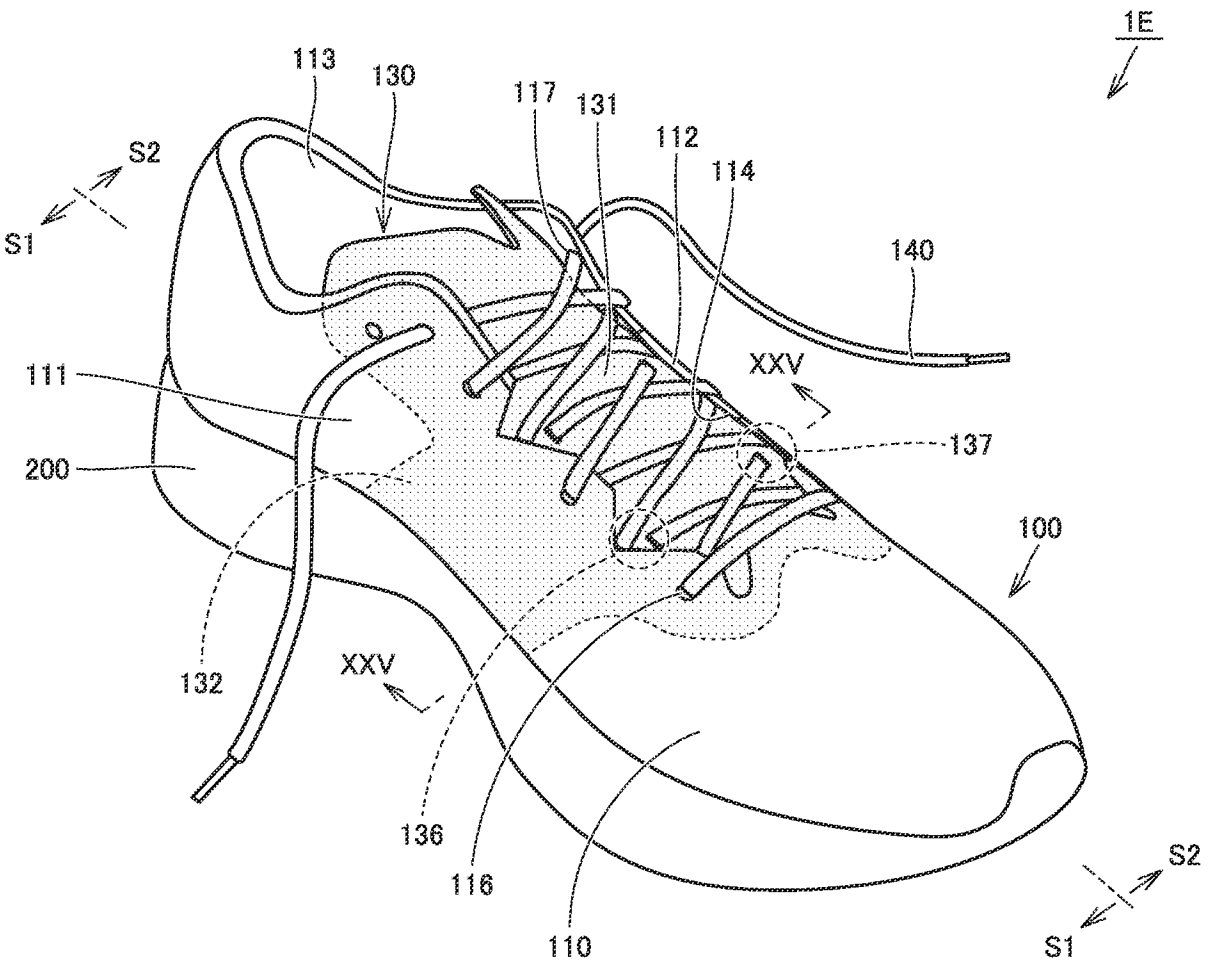
FIG. 23 is a perspective view of a shoe according to a fifth embodiment.
Figure 24:
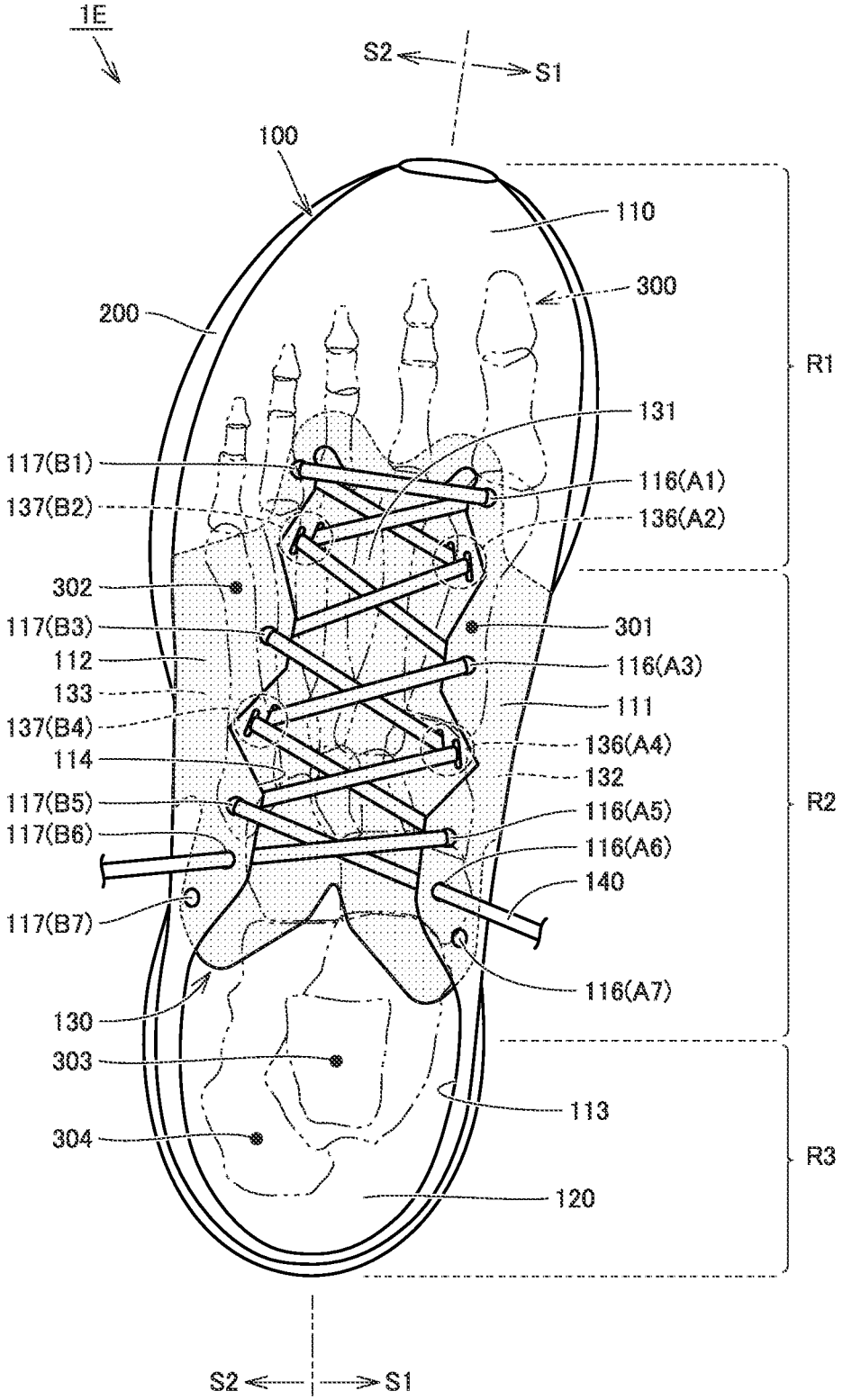
FIG. 24 is a plan view of the shoe shown in FIG. 23.
Figure 25:
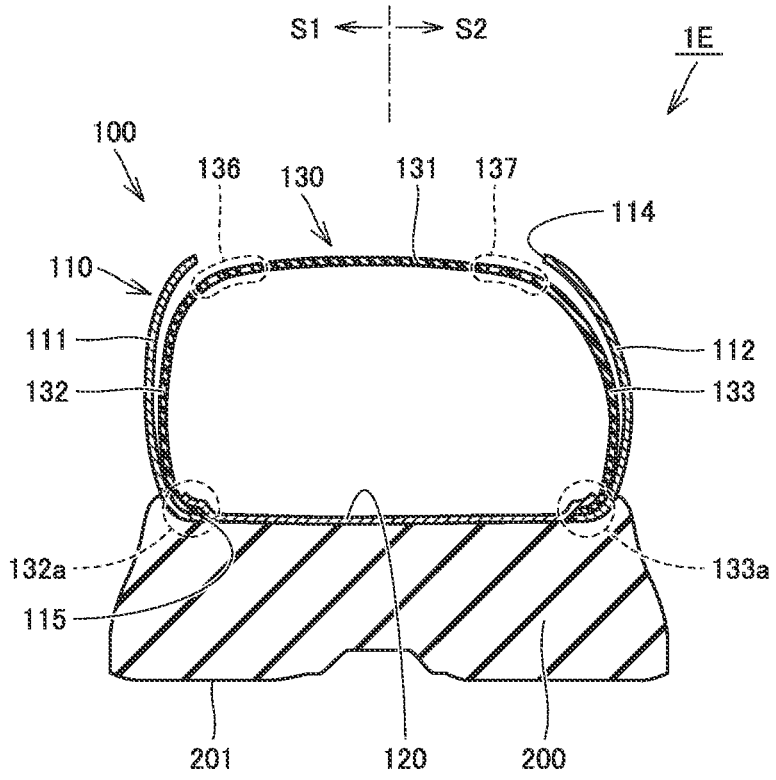
FIG. 25 is a cross-sectional view of the shoe shown in FIG. 23.
Figure 26:
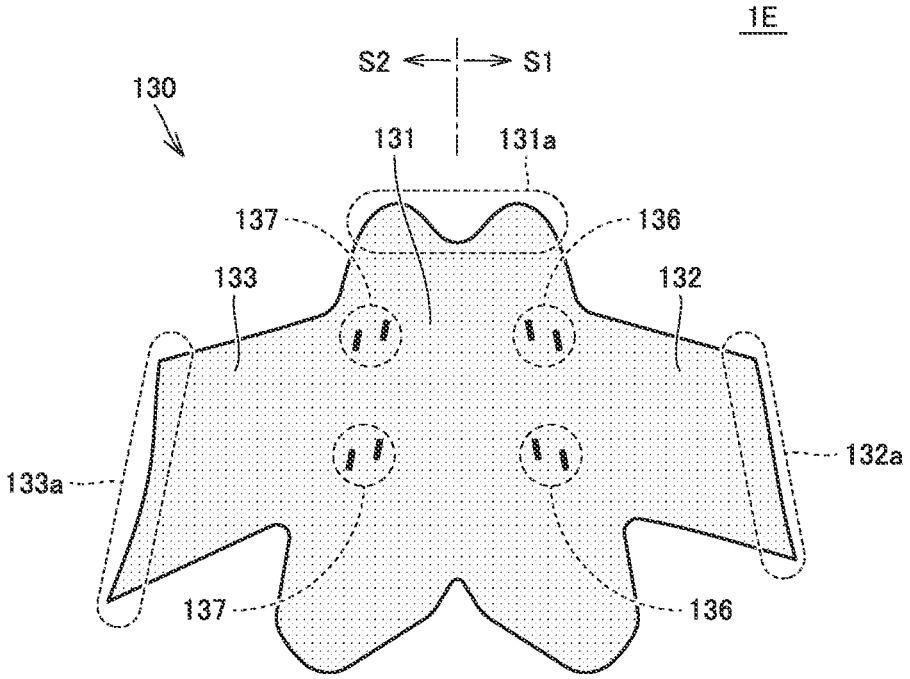
FIG. 26 is a plan view of a shoe tongue shown in FIG. 23 in a developed state.

FIG. 23 is a perspective view of a shoe according to the fifth embodiment. FIG. 24 is a plan view of the shoe shown in FIG. 23. FIG. 25 is a cross-sectional view showing the shoe and taken along a line XXV-XXV in FIG. 23. FIG. 26 is a plan view of a shoe tongue shown in FIG. 23 in a developed state. Referring to FIGS. 23 to 26, the following describes a shoe 1E according to the present embodiment. In FIG. 24, bones 300 of a foot are superimposed on the shoe 1E so as to allow clear understanding of the positional relation between the shoe and the bones of the wearer's foot.

As shown in FIGS. 23 to 26, the shoe 1E is obtained by combining: the configuration on the medial foot side (i.e., the S1 side shown in the figure) of the shoe 1A according to the first embodiment; and the configuration on the lateral foot side (i.e., the S2 side shown in the figure) of the shoe 1C according to the third embodiment.

Specifically, in the shoe 1E, the upper body 110 includes a medial foot-side wall portion 111 as the first wall portion and a lateral foot-side wall portion 112 as the second wall portion, and the shoe tongue 130 includes a medial foot-side extending portion 132 as the first extending portion and a lateral foot-side extending portion 133 as the second extending portion. Further, the shoe tongue 130 is provided with a plurality of shoelace passing-through portions 136 as the shoe tongue-side first shoelace passing-through portions and a plurality of shoelace passing-through portions 137 as the shoe tongue-side second shoelace passing-through portions. Also, the upper body 110 is provided with a plurality of shoelace passing-through portions 116 as the upper-side first shoelace passing-through portions and a plurality of shoelace passing-through portions 117 as the upper-side second shoelace passing-through portions.

The shoe tongue 130 is made of a material higher in stretchability than the material forming the upper body 110. The medial foot-side extending portion 132 is located to extend along the inner surface of the medial foot-side wall portion 111 of the upper body 110 toward the bottom end portion of the medial foot-side wall portion 111, and the lower end of medial foot-side extending portion 132 is fixed to the bottom end portion of the medial foot-side wall portion 111. Further, the lateral foot-side extending portion 133 is located to extend along the inner surface of the lateral foot-side wall portion 112 of the upper body 110 toward the bottom end portion of the lateral foot-side wall portion 112, and the lower end of the lateral foot-side extending portion 133 is fixed to the bottom end portion of the lateral foot-side wall portion 112.

As shown in FIG. 24, among the medial foot-side shoelace passing-through portions A1 to A7 as shoelace passing-through portions disposed in the medial foot-side portion of the upper body 110, the medial foot-side shoelace passing-through portions A1, A3, and A5 to A7 each are formed by the shoelace passing-through portion 116 provided in the medial foot-side wall portion 111 of the upper body 110, and the remaining medial foot-side shoelace passing-through portions A2 and A4 each are formed by the shoelace passing-through portion 136 provided in the shoe tongue 130. Also, among the lateral foot-side shoelace passing-through portions B1 to B7 as shoelace passing-through portions disposed in the lateral foot-side portion of the upper body 110, the lateral foot-side shoelace passing-through portions B1, B3, and B5 to B7 each are formed by the shoelace passing-through portion 117 provided in the lateral foot-side wall portion 112 of the upper body 110, and the remaining lateral foot-side shoelace passing-through portions B2 and B4 each are formed by the shoelace passing-through portion 137 provided in the shoe tongue 130.

The shoelace 140 is inserted in prescribed order through the medial foot-side shoelace passing-through portions A1 to A7 and the lateral foot-side shoelace passing-through portions B1 to B7. However, in the state shown in FIG. 24, an extra hole A7 among the medial foot-side shoelace passing-through portions A1 to A7 and an extra hole B7 among the lateral foot-side shoelace passing-through portions B1 to B7 are not used.

Thus, when attention is paid to the medial foot-side shoelace passing-through portions A1 to A6, from the lateral foot side (i.e., the S2 side shown in the figure), the shoelace 140 is inserted and folded back through each of the plurality of shoelace passing-through portions 116 (i.e., each of the medial foot-side shoelace passing-through portions A1, A3, A5, and A6) provided in the upper body 110. Also, from the lateral foot side (i.e., the S2 side shown in the figure), the shoelace 140 is inserted and folded back through each of the plurality of shoelace passing-through portions 136 (i.e., each of the medial foot-side shoelace passing-through portions A2 and A4) provided in the shoe tongue 130.

Further, when attention is paid to the lateral foot-side shoelace passing-through portions B1 to B6, from the medial foot side (i.e., the S1 side shown in the figure), the shoelace 140 is inserted and folded back through each of the plurality of shoelace passing-through portions 117 (i.e., each of the lateral foot-side shoelace passing-through portions B1, B3, B5, and B6) provided in the upper body 110. Also, from the medial foot side (i.e., the S1 side shown in the figure), the shoelace 140 is inserted and folded back through each of the plurality of shoelace passing-through portions 137 (i.e., each of the lateral foot-side shoelace passing-through portions B2 and B4) provided in the shoe tongue 130.

By the configuration as described above, the shoe 1E according to the present embodiment can achieve both the effect described in the first embodiment and the effect described in the third embodiment. Therefore, the shoe 1E according to the present embodiment can achieve excessively excellent functions both in the stationary fit that is important during a low-intensity exercise and the dynamic fit that is important during a high-intensity exercise, which makes it possible to implement a shoe dramatically enhanced in balance between the stationary fit and the dynamic fit.

Sixth Embodiment

Figure 27:
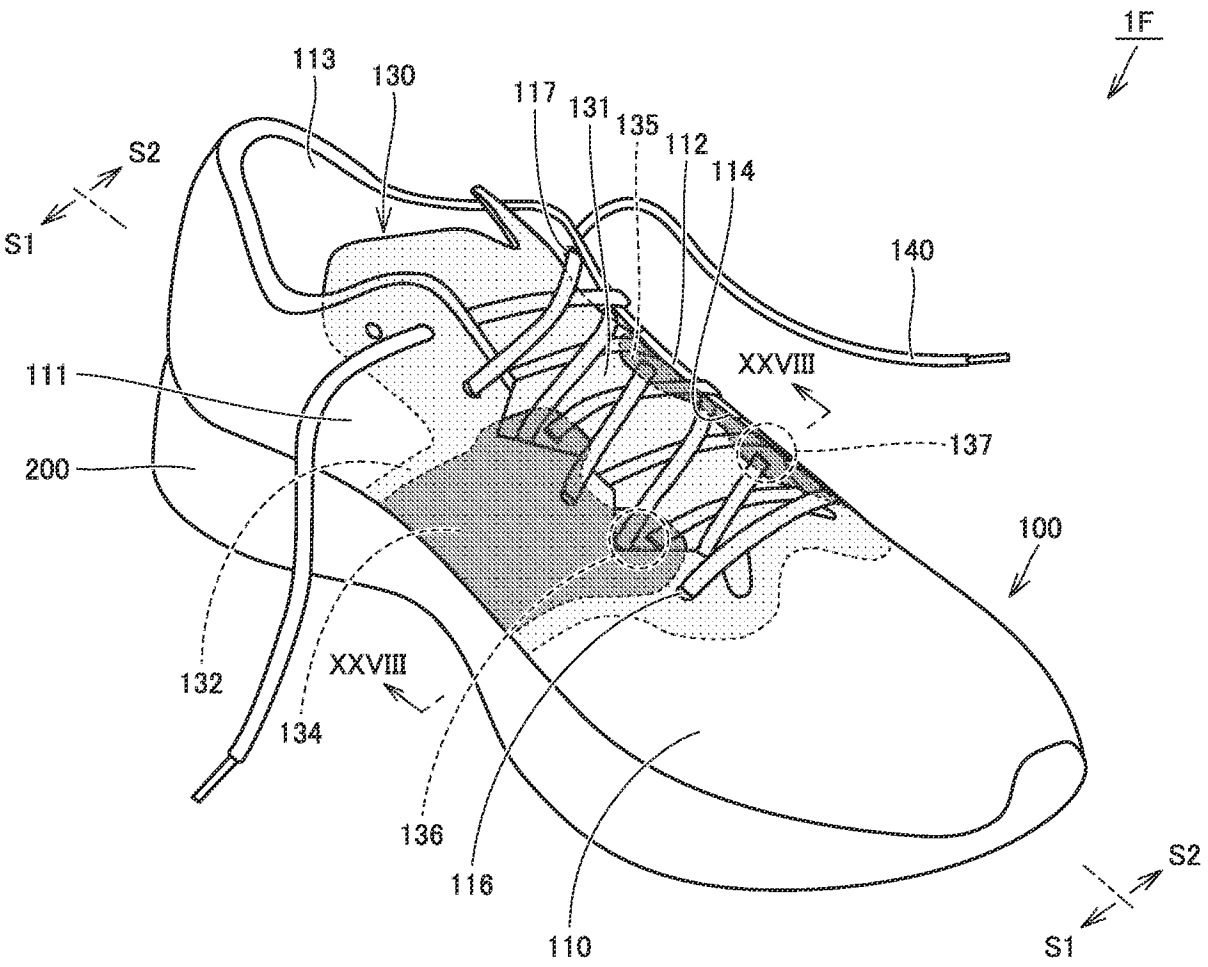
FIG. 27 is a perspective view of a shoe according to a sixth embodiment.
Figure 28:
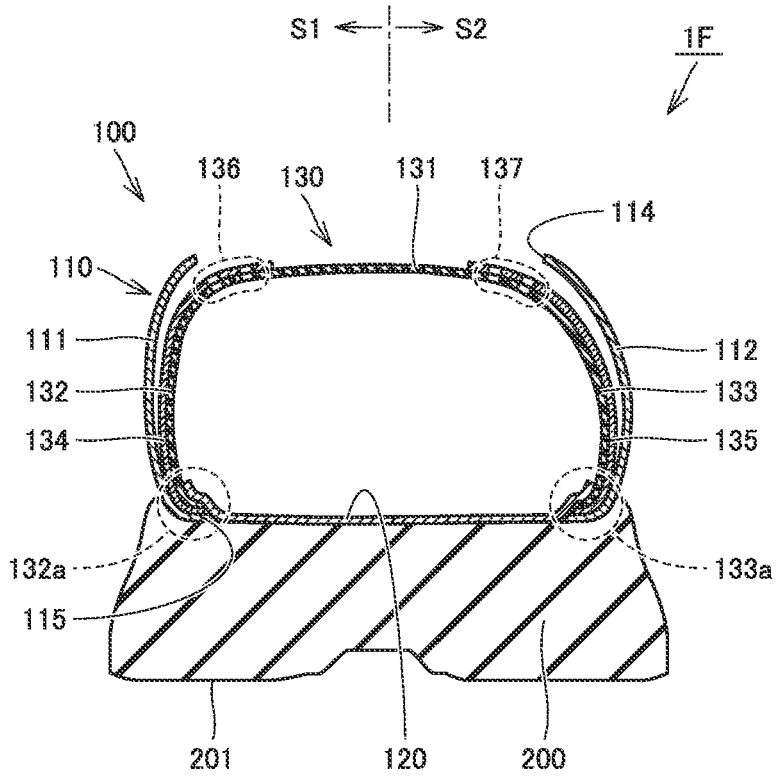
FIG. 28 is a cross-sectional view of the shoe shown in FIG. 27.
Figure 29:
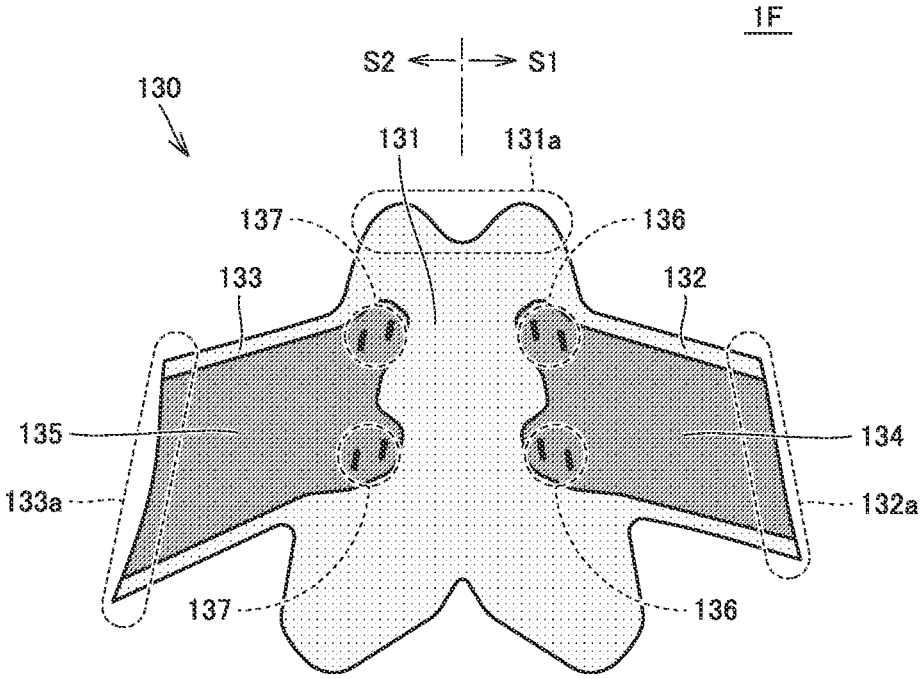
FIG. 29 is a plan view of a shoe tongue shown in FIG. 27 in a developed state.

FIG. 27 is a perspective view of a shoe according to the sixth embodiment. FIG. 28 is a cross-sectional view showing the shoe and taken along a line XXVIII-XXVIII in FIG. 27. FIG. 29 is a plan view of a shoe tongue shown in FIG. 27 in a developed state. Referring to FIGS. 27 to 29, the following describes a shoe 1F according to the present embodiment.

As shown in FIGS. 27 to 29, the shoe 1F is different from the shoe 1E according to the fifth embodiment only in the configuration of the shoe tongue 130. Specifically, in the shoe 1E, the shoe tongue 130 includes a medial foot-side reinforcing portion 134 as the first reinforcing portion and a lateral foot-side reinforcing portion 135 as the second reinforcing portion. In other words, the shoe 1F is obtained by combining: the configuration on the medial foot side (i.e., the S1 side shown in the figure) of the shoe 1B according to the second embodiment; and the configuration on the lateral foot side (i.e., the S2 side shown in the figure) of the shoe 1D according to the fourth embodiment.

The medial foot-side reinforcing portion 134 serves to mainly reinforce the medial foot-side extending portion 132 of the shoe tongue 130, and is provided so as to cover a prescribed portion on the upper surface of the medial foot-side extending portion 132. The medial foot-side reinforcing portion 134 is made of a material higher in stretchability than the material forming the upper body 110 and higher in rigidity than the material forming the medial foot-side extending portion 132 of the shoe tongue 130.

The lateral foot-side reinforcing portion 135 serves to mainly reinforce the lateral foot-side extending portion 133 of the shoe tongue 130, and is provided so as to cover a prescribed portion on the upper surface of the lateral foot-side extending portion 133. The lateral foot-side reinforcing portion 135 is made of a material higher in stretchability than the material forming the upper body 110 and higher in rigidity than the material forming the lateral foot-side extending portion 133 of the shoe tongue 130.

By the configuration as described above, the shoe 1F according to the present embodiment can achieve both the effect described in the second embodiment and the effect described in the fourth embodiment. Therefore, by the shoe 1F according to the present embodiment, excessively excellent functions are exerted both in the stationary fit that is important during a low-intensity exercise and the dynamic fit that is important during a high-intensity exercise. This makes it possible to implement a shoe that is not only dramatically enhanced in balance between the stationary fit and the dynamic fit but is also excellent in durability.

Seventh Embodiment

Figure 30:
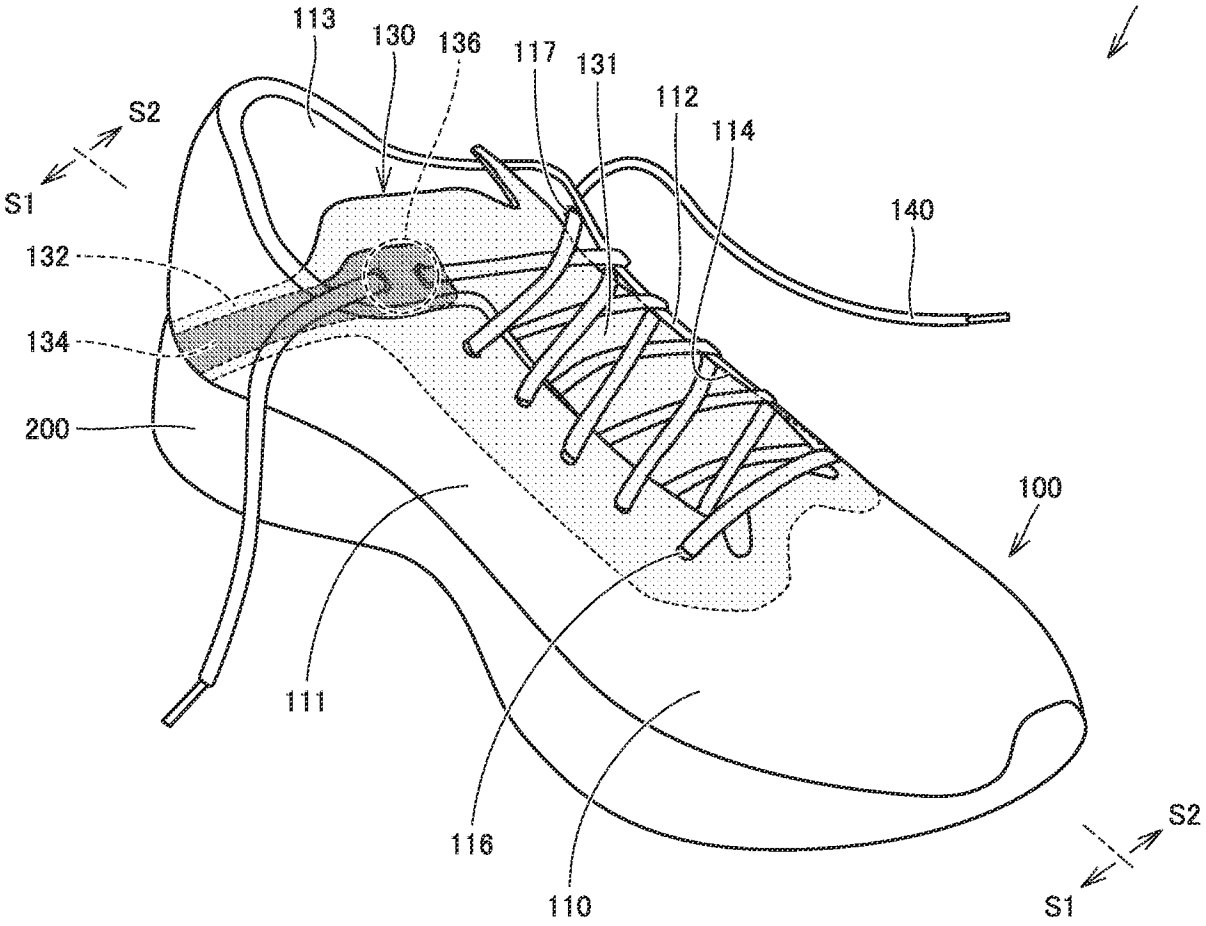
FIG. 30 is a perspective view of a shoe according to a seventh embodiment.

FIG. 30 is a perspective view of a shoe according to the seventh embodiment. Referring to FIG. 30, the following describes a shoe 1G according to the present embodiment.

As shown in FIG. 30, the shoe 1G is different from the shoe 1B according to the second embodiment only in the configurations of the upper body 110 and the shoe tongue 130. Specifically, in the shoe 1G, the shoe tongue 130 includes the medial foot-side extending portion 132 as the first extending portion, but the arrangement position of this medial foot-side extending portion 132 is different, and accordingly, the configuration of the peripheral edge of the central opening 114 of the upper body 110 is also different.

In the shoe 1G according to the present embodiment, the medial foot-side extending portion 132 extends obliquely rearward from the portion on the medial foot side (i.e., the S1 side shown in the figure) and closer to the rear end in the peripheral edge of the cover portion 131 of the shoe tongue 130. Thereby, the medial foot-side extending portion 132 is located to extend along the inner surface of the medial foot-side wall portion 111 of the upper body 110 toward the bottom end portion of the medial foot-side wall portion 111.

Further, the shoe tongue 130 is provided with a medial foot-side reinforcing portion 134 as the first reinforcing portion. The medial foot-side reinforcing portion 134 extends in a strip shape in the extending direction of the medial foot-side extending portion 132 so as to cover a prescribed portion on the upper surface of the medial foot-side extending portion 132.

In this case, in the shoe 1G according to the present embodiment, the medial foot-side extending portion 132 of the shoe tongue 130 extends out from the cover portion 131 in the portion closer to the rear end of the midfoot portion R2, and the lower end of the medial foot-side extending portion 132 is fixed to the bottom end portion of the medial foot-side wall portion 111 of the upper body 110 in the rearfoot portion R3. Thus, both the medial foot-side extending portion 132 and the medial foot-side reinforcing portion 134 are located so as to cover a talus bone 303 and a calcaneus bone 304 of the wearer's foot (see FIGS. 2, 17, and 24 as to the positions of the talus bone 303 and the calcaneus bone 304).

On the other hand, a shoelace passing-through portion 136 as the shoe tongue-side first shoelace passing-through portion is provided in a portion on the medial foot side (i.e., on the S1 side shown in the figure) and closer to the rear end in the cover portion 131 of the shoe tongue 130. In the shoe 1G according to the present embodiment, only one shoelace passing-through portion 136 is provided in the shoe tongue 130, and the medial foot-side shoelace passing-through portion is configured by this one shoelace passing-through portion 136 provided in the shoe tongue 130 and five shoelace passing-through portions 116 provided in the upper body 110 (no extra hole is provided in the medial foot-side portion in the shoe 1G according to the present embodiment).

In this case, the shoelace passing-through portion 136 provided in the shoe tongue 130 is located on the rearmost side in the front-rear direction in the medial foot-side shoelace passing-through portions. Thus, when the shoelace 140 inserted through the shoelace passing-through portions is tied, then, from the lateral foot side (i.e., the S2 side shown in the figure), the shoelace 140 is inserted and folded back through this shoelace passing-through portion 136.

In the configuration as described above, in the shoe tongue 130, the medial foot-side extending portion 132 is made of a material higher in stretchability than the material forming the medial foot-side wall portion 111 of the upper body 110, and the medial foot-side reinforcing portion 134 is made of a material higher in stretchability than the material forming the medial foot-side wall portion 111 of the upper body 110 and higher in rigidity than the material forming the medial foot-side extending portion 132 of the shoe tongue 130. Thus, similarly to the case in the second embodiment, a shoe balanced between the stationary fit and the dynamic fit can be obtained, and particularly, the stationary fit on a portion closer to the rearfoot portion R3 in the entire shoe can be improved.

Further, in the configuration as described above, each of the medial foot-side extending portion 132 and the medial foot-side reinforcing portion 134 is located to cover the talus bone 303 and the calcaneus bone 304 of the wearer's foot, so that the medial foot-side extending portion 132 and the medial foot-side reinforcing portion 134 can suppress excessive inclination of the calcaneus bone 304. Therefore, employing this configuration can suppress the occurrence of overpronation (a phenomenon in which the wearer's heel portion collapses inward more than necessary when landing on the ground).

In this case, from the viewpoint of suppressing the occurrence of such overpronation, it is preferable to provide the medial foot-side extending portion 132 and the medial foot-side reinforcing portion 134 so as to include a position ranging from the front end of the shoe to 70% to 90% of the dimension of the shoe in the front-rear direction with respect to the front end of the shoe.

The shoe 1G according to the present embodiment has been exemplified with regard to the case where the shoe tongue 130 is provided with not only the medial foot-side extending portion 132 but also the medial foot-side reinforcing portion 134.

However, also when the shoe tongue 130 is provided with only the medial foot-side extending portion 132, a corresponding effect can be achieved.

Eighth Embodiment

Figure 31:
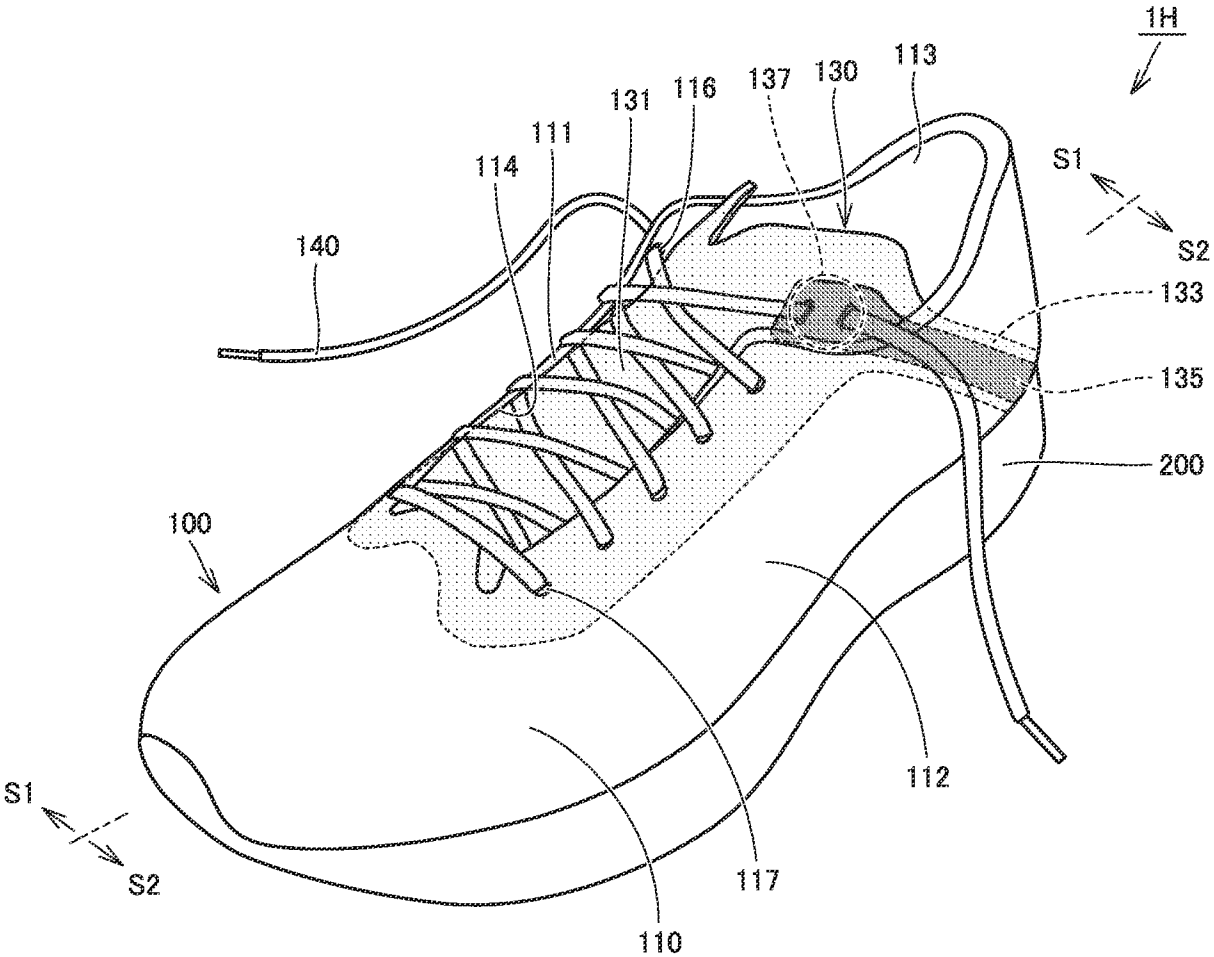
FIG. 31 is a perspective view of a shoe according to an eighth embodiment.

FIG. 31 is a perspective view of a shoe according to the eighth embodiment. Referring to FIG. 31, the following describes a shoe 1H according to the present embodiment.

As shown in FIG. 31, the shoe 1H is different from the shoe 1D according to the fourth embodiment only in the configurations of the upper body 110 and the shoe tongue 130. Specifically, in the shoe 1H, the shoe tongue 130 includes the lateral foot-side extending portion 133 as the first extending portion, but the arrangement position of the lateral foot-side extending portion 133 is different, and accordingly, the configuration of the peripheral edge of the central opening 114 of the upper body 110 is also different.

In the shoe 1H according to the present embodiment, the lateral foot-side extending portion 133 extends obliquely rearward from the portion on the lateral foot side (i.e., the S2 side shown in the figure) and closer to the rear end in the peripheral edge of the cover portion 131 of the shoe tongue 130. Thereby, the lateral foot-side extending portion 133 is located to extend along the inner surface of the lateral foot-side wall portion 112 of the upper body 110 toward the bottom end portion of the lateral foot-side wall portion 112.

Further, the shoe tongue 130 is provided with a lateral foot-side reinforcing portion 135 as the first reinforcing portion. The lateral foot-side reinforcing portion 135 extends in a strip shape in the extending direction of the lateral foot-side extending portion 133 so as to cover a prescribed portion on the upper surface of the lateral foot-side extending portion 133.

In the shoe 1H according to the present embodiment, the lateral foot-side extending portion 133 of the shoe tongue 130 extends out from the cover portion 131 in the portion closer to the rear end of the midfoot portion R2, and the lower end of the lateral foot-side extending portion 133 is fixed to the bottom end portion of the lateral foot-side wall portion 112 of the upper body 110 in the rearfoot portion R3. Thus, both the lateral foot-side extending portion 133 and the lateral foot-side reinforcing portion 135 are located so as to cover the talus bone 303 and the calcaneus bone 304 of the wearer's foot (see FIGS. 2, 17, and 24 as to the positions of the talus bone 303 and the calcaneus bone 304).

On the other hand, a shoelace passing-through portion 137 as the shoe tongue-side first shoelace passing-through portion is provided in a portion on the lateral foot side (i.e., on the S2 side shown in the figure) and closer to the rear end in the cover portion 131 of the shoe tongue 130. In the shoe 1H according to the present embodiment, only one shoelace passing-through portion 137 is provided in the shoe tongue 130, and the lateral foot-side shoelace passing-through portion is configured by this one shoelace passing-through portion 137 provided in the shoe tongue 130 and five shoelace passing-through portions 117 provided in the upper body 110 (no extra hole is provided in the lateral foot-side portion in the shoe 1H according to the present embodiment).

In this case, the shoelace passing-through portion 137 provided in the shoe tongue 130 is located on the rearmost side in the front-rear direction in the lateral foot-side shoelace passing-through portions. Thus, when the shoelace 140 inserted through the shoelace passing-through portions is tied, then, from the medial foot side (i.e., the S1 side shown in the figure), the shoelace 140 is inserted and folded back through this shoelace passing-through portion 137.

In the configuration as described above, in the shoe tongue 130, the lateral foot-side extending portion 133 is made of a material higher in stretchability than the material forming the lateral foot-side wall portion 112 of the upper body 110, and the lateral foot-side reinforcing portion 135 is made of a material higher in stretchability than the material forming the lateral foot-side wall portion 112 of the upper body 110 and higher in rigidity than the material forming the lateral foot-side extending portion 133 of the shoe tongue 130. Thus, similarly to the case in the second embodiment, a shoe balanced between the stationary fit and the dynamic fit can be obtained, and particularly, the stationary fit on a portion closer to the rearfoot portion R3 in the entire shoe can be improved.

Further, in the configuration as described above, each of the lateral foot-side extending portion 133 and the lateral foot-side reinforcing portion 135 is located to cover the talus bone 303 and the calcaneus bone 304 of the wearer's foot, so that the lateral foot-side extending portion 133 and the lateral foot-side reinforcing portion 135 can suppress abnormal inclination of the calcaneus bone 304. Therefore, employing this configuration can suppress the occurrence of excessive underpronation (a phenomenon in which the wearer's heel portion does not properly collapse inward but collapses outward when landing on the ground).

Thus, from the viewpoint of suppressing the occurrence of such excessive underpronation, it is preferable to provide the lateral foot-side extending portion 133 and the lateral foot-side reinforcing portion 135 so as to include a position ranging from the front end of the shoe to 70% to 90% of the dimension of the shoe in the front-rear direction with respect to the front end of the shoe.

The shoe 1H according to the present embodiment has been exemplified with regard to the case where the shoe tongue 130 is provided with not only the lateral foot-side extending portion 133 but also the lateral foot-side reinforcing portion 135. However, also when the shoe tongue 130 is provided with only the lateral foot-side extending portion 133, a corresponding effect can be achieved.

Summary of the Disclosure in Embodiments and the Like

The following summarizes the characteristic configurations disclosed in the first to eighth embodiments and the modifications thereof as described above.

A shoe according to an aspect of the present disclosure includes: an upper body provided with a top opening into which a foot of a wearer is inserted, and a central opening extending from the top opening toward a front side in a front-rear direction corresponding to a foot length direction of the foot of the wearer; a shoe tongue disposed inside the upper body to cover the central opening from inside the upper body; and a shoelace for tightening a portion of the upper body in a left-right direction corresponding to a foot width direction of the foot of the wearer, the portion of the upper body defining the central opening. The upper body includes a first wall portion and a second wall portion as a pair of side wall portions facing each other in the left-right direction, and the top opening and the central opening are defined by a top end portion of the first wall portion and a top end portion of the second wall portion. The shoe tongue includes a cover portion that covers the central opening, and a first extending portion extending from an end portion of the cover portion on a side close to the first wall portion toward a bottom end portion of the first wall portion along an inner surface of the first wall portion, the first extending portion having a lower end, the lower end being fixed. The first extending portion is made of a material higher in stretchability than a material forming the first wall portion. A portion defining the central opening in the top end portion of the first wall portion is provided with at least one upper body-side first shoelace passing-through portion through which the shoelace is inserted from a side of the second wall portion and folded back, and the shoe tongue is provided with at least one shoe tongue-side first shoelace passing-through portion through which the shoelace is inserted from a side of the second wall portion and folded back.

In the shoe according to an aspect of the present disclosure, it is preferable that the first extending portion is located at least in a portion corresponding to a metatarsal bone of the foot of the wearer.

In the shoe according to an aspect of the present disclosure, it is preferable that the first extending portion is located at least in a portion corresponding to a talus bone and a calcaneus bone of the foot of the wearer.

In the shoe according to an aspect of the present disclosure, the shoe tongue may include a first reinforcing portion provided at least in the first extending portion to reinforce the first extending portion. In this case, it is preferable that the first reinforcing portion is made of a material higher in stretchability than a material forming the first wall portion and higher in rigidity than a material forming the first extending portion.

In the shoe according to an aspect of the present disclosure, the first reinforcing portion may be provided in the shoe tongue to extend from a portion of the first extending portion that is fixed to the upper body to a portion provided with the shoe tongue-side first shoelace passing-through portion.

In the shoe according to an aspect of the present disclosure, the first reinforcing portion may be formed of a layered member that covers a surface of the shoe tongue.

In the shoe according to an aspect of the present disclosure, the shoe tongue may further include a second extending portion extending from an end portion of the cover portion on a side close to the second wall portion toward a bottom end portion of the second wall portion along an inner surface of the second wall portion, the second extending portion having a lower end, the lower end being fixed. In this case, the second extending portion may be made of a material higher in stretchability than a material forming the second wall portion. Further, in this case, it is preferable that a portion defining the central opening in the top end portion of the second wall portion is provided with at least one upper body-side second shoelace passing-through portion through which the shoelace is inserted from a side of the first wall portion and folded back, and it is also preferable that the shoe tongue is provided with at least one shoe tongue-side second shoelace passing-through portion through which the shoelace is inserted from a side of the first wall portion and folded back.

In the shoe according to an aspect of the present disclosure, it is preferable that the second extending portion is located at least in a portion corresponding to a metatarsal bone of the foot of the wearer.

In the shoe according to an aspect of the present disclosure, it is preferable that the second extending portion is located at least in a portion corresponding to a talus bone and a calcaneus bone of the foot of the wearer.

In the shoe according to an aspect of the present disclosure, the shoe tongue may include a second reinforcing portion provided at least in the second extending portion to reinforce the second extending portion. In this case, it is preferable that the second reinforcing portion is made of a material higher in stretchability than a material forming the second wall portion and higher in rigidity than a material forming the second extending portion.

In the shoe according to an aspect of the present disclosure, the second reinforcing portion may be provided in the shoe tongue to extend from a portion of the second extending portion that is fixed to the upper body to a portion provided with the shoe tongue-side second shoelace passing-through portion.

In the shoe according to an aspect of the present disclosure, the second reinforcing portion may be formed of a layered member that covers a surface of the shoe tongue.

In the shoe according to an aspect of the present disclosure, the cover portion may be made of a material higher in stretchability than a material forming the upper body.

In the shoe according to an aspect of the present disclosure, the first wall portion may be a wall portion on a medial foot side of the upper body, and the second wall portion may be a wall portion on a lateral foot side of the upper body.

In the shoe according to an aspect of the present disclosure, the first wall portion may be a wall portion on a lateral foot side of the upper body, and the second wall portion may be a wall portion on a medial foot side of the upper body.

OTHER EMBODIMENTS

The first to eighth embodiments and the modifications thereof have been exemplified above with reference to the configuration in which each of the shoelace passing-through portions to be provided in the upper body and the shoe tongue is formed by a through hole provided in the upper body and the shoe tongue, but each shoelace passing-through portion does not necessarily need to have such a configuration, and may be formed by providing a holding member having a hook shape, a ring shape or the like in the upper body and/or the shoe tongue.

Further, the first to eighth embodiments and the modifications thereof have been exemplified above with reference to the configuration in which the upper includes an insole, but the insole is not necessarily an essential configuration and may not be provided. In this case, a sole is joined to the bottom end portion of the upper body and thereby fixed to the upper.

Further, the specific shapes, configurations, numbers, positions, materials, and the like of the respective portions described in the first to eighth embodiments and the modifications thereof as described above can be modified as appropriate without departing from the gist of the present invention.

Further, the characteristic configurations disclosed in the first to eighth embodiments and the modifications thereof as described above can be combined with one another without departing from the gist of the present invention.

Thus, the embodiments and the modifications disclosed herein are illustrative and non-restrictive in any respect. The technical scope of the present invention is defined by the terms of the claims, and is intended to include any modifications within the meaning and scope equivalent to the terms of the claims.

REFERENCE SIGNS LIST

1A to 1H, 1B1 to 1B8 shoe, 100 upper, 110 upper body, 111 medial foot-side wall portion, 112 lateral foot-side wall portion, 113 top opening, 114 central opening, 115 lower opening, 116, 117 shoelace passing-through portion, 120 insole, 130 shoe tongue, 131 cover portion, 131*a* fixing portion, 132 medial foot-side extending portion, 132*a* fixing portion, 133 lateral foot-side extending portion, 133*a* fixing portion, 134 medial foot-side reinforcing portion, 135 lateral foot-side reinforcing portion, 136, 137 shoelace passing-through portion, 140 shoelace, 200 sole, 201 ground contact surface, 300 bones of foot, 301 first metatarsal bone, 302 fifth metatarsal bone, 303 talus bone, 304 calcaneus bone, A1 to A7 medial foot-side shoelace passing-through portion, B1 to B7 lateral foot-side shoelace passing-through portion, R1 forefoot portion, R2 midfoot portion, R3 rearfoot portion.

The invention claimed is:

1. A shoe comprising:

an upper body provided with a top opening into which a foot of a wearer is inserted, and a central opening extending from the top opening toward a front side in a front-rear direction corresponding to a foot length direction of the foot of the wearer;

a shoe tongue disposed inside the upper body to cover the central opening from inside the upper body; and a shoelace for tightening a portion of the upper body in a left-right direction corresponding to a foot width direction of the foot of the wearer, the portion of the upper body defining the central opening, wherein the upper body includes a first wall portion and a second wall portion as a pair of side wall portions facing each other in the left-right direction, the top opening and the central opening are defined by a top end portion of the first wall portion and a top end portion of the second wall portion, the shoe tongue includes a cover portion that covers the central opening, and a first extending portion extending from an end portion of the cover portion on a side close to the first wall portion toward a bottom end portion of the first wall portion along an inner surface of the first wall portion, the first extending portion having a lower end, the first extending portion is made of a material higher in stretchability than a material forming the first wall portion, a portion defining the central opening in the top end portion of the first wall portion is provided with at least one upper body-side first shoelace passing-through portion through which the shoelace is inserted from a side of the second wall portion and folded back, the shoe tongue is provided with at least one shoe tongue-side first shoelace passing-through portion through which the shoelace is inserted from a side of the second wall portion and folded back, the shoe tongue includes a first reinforcing portion provided at least in the first extending portion to reinforce the first extending portion, the first reinforcing portion is made of a material higher in stretchability than a material forming the first wall portion and higher in rigidity than a material forming the first extending portion, and the first reinforcing portion is provided in the shoe tongue to extend from a portion of the first extending portion that is fixed to the upper body to a portion provided with the shoe tongue-side first shoelace passing-through portion.

2. The shoe according to claim 1, wherein the shoe tongue further includes a second extending portion extending from an end portion of the cover portion on a side close to the second wall portion toward a bottom end portion of the second wall portion along an inner surface of the second wall portion, the second extending portion having a lower end, the second extending portion is made of a material higher in stretchability than a material forming the second wall portion, a portion defining the central opening in the top end portion of the second wall portion is provided with at least one upper body-side second shoelace passing-through portion through which the shoelace is inserted from a side of the first wall portion and folded back, and the shoe tongue is provided with at least one shoe tongue-side second shoelace passing-through portion through which the shoelace is inserted from a side of the first wall portion and folded back.

3. The shoe according to claim 2, wherein the second extending portion is located at least in a portion corresponding to a metatarsal bone of the foot of the wearer.

4. The shoe according to claim 2, wherein the second extending portion is located at least in a portion corresponding to a talus bone and a calcaneus bone of the foot of the wearer.

5. The shoe according to claim 2, wherein the shoe tongue includes a second reinforcing portion provided at least in the second extending portion to reinforce the second extending portion, and the second reinforcing portion is made of a material higher in stretchability than a material forming the second wall portion and higher in rigidity than a material forming the second extending portion.

6. The shoe according to claim 5, wherein the second reinforcing portion is provided in the shoe tongue to extend from a portion of the second extending portion that is fixed to the upper body to a portion provided with the shoe tongue-side second shoelace passing-through portion.

7. The shoe according to claim 5, wherein the second reinforcing portion is formed of a layered member that covers a surface of the shoe tongue.

8. The shoe according to claim 1, wherein the cover portion is made of a material higher in stretchability than a material forming the upper body.

9. The shoe according to claim 1, wherein the first wall portion is a wall portion on a medial foot side of the upper body, and the second wall portion is a wall portion on a lateral foot side of the upper body.

10. The shoe according to claim 1, wherein the first wall portion is a wall portion on a lateral foot side of the upper body, and the second wall portion is a wall portion on a medial foot side of the upper body.

11. A shoe comprising:

an upper body provided with a top opening into which a foot of a wearer is inserted, and a central opening extending from the top opening toward a front side in a front-rear direction corresponding to a foot length direction of the foot of the wearer;

a shoe tongue disposed inside the upper body to cover the central opening from inside the upper body; and a shoelace for tightening a portion of the upper body in a left-right direction corresponding to a foot width direction of the foot of the wearer, the portion of the upper body defining the central opening, wherein the upper body includes a first wall portion and a second wall portion as a pair of side wall portions facing each other in the left-right direction, the top opening and the central opening are defined by a top end portion of the first wall portion and a top end portion of the second wall portion, the shoe tongue includes a cover portion that covers the central opening, and a first extending portion extending from an end portion of the cover portion on a side close to the first wall portion toward a bottom end portion of the first wall portion along an inner surface of the first wall portion, the first extending portion having a lower end, the first extending portion is made of a material higher in stretchability than a material forming the first wall portion, a portion defining the central opening in the top end portion of the first wall portion is provided with at least one upper body-side first shoelace passing-through portion through which the shoelace is inserted from a side of the second wall portion and folded back, the shoe tongue is provided with at least one shoe tongue-side first shoelace passing-through portion through which the shoelace is inserted from a side of the second wall portion and folded back, the shoe tongue includes a first reinforcing portion provided at least in the first extending portion to reinforce the first extending portion, and the first reinforcing portion is made of a material higher in stretchability than a material forming the first wall portion and higher in rigidity than a material forming the first extending portion, and the first reinforcing portion is formed of a layered member that covers a surface of the shoe tongue.

12. The shoe according to claim 11, wherein the shoe tongue further includes a second extending portion extending from an end portion of the cover portion on a side close to the second wall portion toward a bottom end portion of the second wall portion along an inner surface of the second wall portion, the second extending portion having a lower end, the second extending portion is made of a material higher in stretchability than a material forming the second wall portion, a portion defining the central opening in the top end portion of the second wall portion is provided with at least one upper body-side second shoelace passing-through portion through which the shoelace is inserted from a side of the first wall portion and folded back, and the shoe tongue is provided with at least one shoe tongue-side second shoelace passing-through portion through which the shoelace is inserted from a side of the first wall portion and folded back.

13. The shoe according to claim 12, wherein the second extending portion is located at least in a portion corresponding to a metatarsal bone of the foot of the wearer.

14. The shoe according to claim 12, wherein the second extending portion is located at least in a portion corresponding to a talus bone and a calcaneus bone of the foot of the wearer.

15. The shoe according to claim 12, wherein the shoe tongue includes a second reinforcing portion provided at least in the second extending portion to reinforce the second extending portion, and the second reinforcing portion is made of a material higher in stretchability than a material forming the second wall portion and higher in rigidity than a material forming the second extending portion.

16. The shoe according to claim 15, wherein the second reinforcing portion is provided in the shoe tongue to extend from a portion of the second extending portion that is fixed to the upper body to a portion provided with the shoe tongue-side second shoelace passing-through portion.

17. The shoe according to claim 15, wherein the second reinforcing portion is formed of a layered member that covers a surface of the shoe tongue.

18. The shoe according to claim 11, wherein the cover portion is made of a material higher in stretchability than a material forming the upper body.

19. The shoe according to claim 11, wherein the first wall portion is a wall portion on a medial foot side of the upper body, and the second wall portion is a wall portion on a lateral foot side of the upper body.

20. The shoe according to claim 11, wherein the first wall portion is a wall portion on a lateral foot side of the upper body, and the second wall portion is a wall portion on a medial foot side of the upper body.

* * * * *